US010518134B2

(12) United States Patent
O'Brien et al.

(10) Patent No.: US 10,518,134 B2
(45) Date of Patent: Dec. 31, 2019

(54) POGOSTICK WITH WATER FIRING APPARATUS

(71) Applicants: Bruce O'Brien, Stansted Essex (GB); Alan Eady, Hundon Suffolk (GB); Graham Mitson, Clare Suffolk (GB)

(72) Inventors: Bruce O'Brien, Stansted Essex (GB); Alan Eady, Hundon Suffolk (GB); Graham Mitson, Clare Suffolk (GB)

( * ) Notice: Subject to any disclaimer, the term of this patent is extended or adjusted under 35 U.S.C. 154(b) by 0 days.

(21) Appl. No.: 15/755,846

(22) PCT Filed: Aug. 31, 2016

(86) PCT No.: PCT/GB2016/052698
§ 371 (c)(1),
(2) Date: Feb. 27, 2018

(87) PCT Pub. No.: WO2017/037455
PCT Pub. Date: Mar. 9, 2017

(65) Prior Publication Data

US 2018/0326260 A1 Nov. 15, 2018

(30) Foreign Application Priority Data

Sep. 2, 2015 (GB) ..... 1515554.2

(51) Int. Cl.
*A63B 25/08* (2006.01)
*A63H 23/10* (2006.01)
*F41B 9/00* (2006.01)

(52) U.S. Cl.
CPC ..... *A63B 25/08* (2013.01); *A63B 2209/10* (2013.01); *A63F 2250/0428* (2013.01); *F41B 9/0028* (2013.01)

(58) Field of Classification Search
CPC ..... A63B 25/00; A63B 25/08; A63B 2208/12; A63B 2208/0204; B05B 17/00; A63H 23/00; A63H 23/10; A63H 23/12; A63H 29/14
USPC ..... 482/77, 112, 51; 472/135; 446/153, 180, 446/183, 186, 475, 483
See application file for complete search history.

(56) References Cited

U.S. PATENT DOCUMENTS 2,929,459 A 3/1960 Spitzmesser
3,074,715 A 1/1963 Taylor
3,782,352 A 1/1974 Sparber
4,235,378 A * 11/1980 Melin ..... A63H 23/10 239/229
4,967,734 A * 11/1990 Rennex ..... A43B 13/182 482/51
5,603,361 A 2/1997 Cuisinier
8,490,831 B1 * 7/2013 Wong ..... A63H 23/10 222/79

* cited by examiner

*Primary Examiner* — Kien T Nguyen
(74) *Attorney, Agent, or Firm* — Renner Kenner Greive Bobak Taylor & Weber

(57) ABSTRACT

A pogo stick (100) comprising a frame (102); an elongate member (104) in sprung connection with the frame, for reciprocating motion between the elongate member and the frame; a liquid container (110) arranged, in use, to contain a liquid; and firing apparatus (108) arranged to utilise the reciprocating motion between the elongate member (104) and the frame (102) to expel the liquid in the liquid container (110) from the pogo stick (100).

19 Claims, 17 Drawing Sheets

POGOSTICK WITH WATER FIRING APPARATUS

The invention relates to pogo sticks. Pogo sticks are well-known and generally comprise an elongated sprung stick or pole connected to a frame. Pogo sticks can be used as a toy on which a user, such as a child, bounces. Bouncing on a pogo stick may be substantially in the vertical plane, or may comprise a horizontal component to the movement in addition to vertical movement.

According to a first aspect of the invention, there is provided a pogo stick comprising:

a frame;

an elongate member in sprung connection with the frame, for reciprocating motion between the elongate member and the frame;

a liquid container arranged, in use, to contain a liquid; and firing apparatus, the firing apparatus being arranged to utilise the reciprocating motion between the elongate member and the frame to expel the liquid in the liquid container from the pogo stick.

The skilled person would understand that the liquid stored on, and fired from, the pogo stick may be any fluid, but that a liquid, and in particular water may be preferred in at least some embodiments. In some embodiments, a gas may be expelled from the pogo stick through a liquid film, for example so as to blow bubbles. In such embodiments, the liquid in the liquid container may be a soap solution or other surfactant-containing liquid, and atmospheric air may be pumped through films of the liquid in a nozzle or ring to produce bubbles.

Further, the reciprocating motion may be provided by a user of the pogo stick bouncing up and down on the pogo stick in a manner well known in the art.

The firing apparatus may comprise a pump.

The pogo stick may comprise a further container arranged, in use, to contain a compressible fluid. The skilled person would understand that a gas, and preferably air, may be used as the compressible fluid. The pump may be used to pressurise the compressible fluid.

The compressible fluid may be pressurised by introduction of liquid from the liquid container into the compressible fluid container, or alternatively by the introduction of air from the atmosphere into the compressible fluid container.

The pogo stick may further comprise a trigger, wherein when the trigger is activated, the liquid is expelled.

The pogo stick may further comprise one or more outlets. The or each outlet may be pointed in a forward direction, i.e. in the direction a user would be facing whilst using the pogo stick, and so away from the user, so that liquid is expelled forwards. The user may therefore be described as being located on the back of the pogo stick. In embodiments with multiple outlets, the outlets may face in different directions, and/or may be located at different heights.

In embodiments wherein the compressible fluid is pressurised by introduction of liquid from the liquid container into the compressible fluid container, a valve between the compressible fluid container and an outlet may be opened when the trigger is pressed, such that expansion of the compressible fluid within the compressible fluid container expels the liquid from compressible fluid container via the outlet.

In embodiments wherein the compressible fluid is pressurised by the introduction of air from the atmosphere into the compressible fluid container, when the trigger is activated, a valve between the at least one liquid container and the compressible fluid container may be opened such that expansion of the compressible fluid into the liquid container expels the liquid from the at least one liquid container. In some embodiments, the compressible fluid may be forced into the liquid container as it is compressed so as to pressurise the liquid container, for example with a piston within the compressible fluid container and a one-way valve between the compressible fluid container and the liquid container. When the trigger is activated, a valve between an outlet and the liquid container may be opened to allow the liquid to be ejected.

The pogo stick may further comprise a pressure release valve arranged to vent some or all of the compressible fluid, for example from the compressible fluid container and/or from the liquid container, if the pressure exceeds a threshold. Advantageously, the release of excess pressure reduces the risk of damage to valves or pipes.

Additionally or alternatively, the pogo stick may further comprise a pressure release valve arranged to vent some or all of the liquid if the pressure exceeds a threshold.

The liquid and compressible fluid containers may be arranged in various ways, for example:

the at least one container may be located on the opposite side of the frame from an expected position of a user (i.e. on the front of the pogo stick);

the at least one liquid container may be aligned parallel to, and located close to, a vertical axis of the pogo stick;

at least two liquid containers may be used, and these containers may be arranged symmetrically with respect to a vertical axis of the pogo stick; and/or the at least one liquid container may be arranged near a lower end of the pogo stick such that the centre of mass of the pogo stick is lower, advantageously improving balance.

The pogo stick may further comprise a foot on the lower end of the elongate member, arranged, in use, to contact the ground. Optionally, the foot is a stabilising foot, which allows a user to balance in a stationary upright position. The stabilising foot may be broad, and/or may comprise a balancing mechanism or shape.

The pogo stick may further comprise a trigger and an outlet for the liquid, arranged such that the liquid is expelled through the outlet when the trigger is activated.

The elongate member may be connected to the frame by a spring. The spring may be coiled around the elongate member.

The pogo stick may comprise handles and/or one or more footrests attached to, or integral with, the frame.

The pump may comprise two pump sections, which may be a piston and a compression chamber. The compression chamber is referred to as the compressible fluid container in some embodiments. The piston may be referred to as a rod or connecting rod and the compression chamber may be referred to as a valve body. One pump section may be connected to the frame and the other pump section to the elongate member.

The pogo stick may further comprise one or more outlets for the liquid. At least one outlet may be pivotable such that a direction in which liquid is expelled can be varied. A control lever may be provided for pivoting the outlet.

A shield or casing may also be provided, arranged to protect the or each container from impacts.

More than one liquid container may be used, and that more than one compressible fluid container may be used.

The or each container (liquid and/or compressible fluid containers) may be connected to the frame, and may be detachable and re-attachable, optionally by the use of one or more clips, buckles, press studs, Velcro® or the likes.

According to a second aspect of the invention, there is provided a pogo stick set comprising: the pogo stick as described with respect to the first aspect; a selection of containers of various sizes; and a plurality of detachable connectors arranged, in use, to connect one or more of the containers to the pogo stick.

The plurality of detachable containers may come in a variety of shapes and sizes. The containers may be made of different materials, for example plastic, metal or composite materials. Different colours may also be provided.

The pogo stick set may further comprise replacement connectors, for example additional clips, buckles or the like. In embodiments wherein handles and/or footrests of the pogo stick are connected to the frame instead of being integral with the frame, additional handles and/or footrests may be provided.

The pogo stick set may further comprise one or more detachable shields or casings, arranged, in use, to protect the or each container connected to the pogo stick from impacts.

According to a third aspect of the invention, there is provided a kit of parts for modifying a pogo stick to have water-firing capabilities. The kit of parts comprises: a liquid container arranged to contain a liquid; a connector arranged, in use, to connect the liquid container to the pogo stick; and firing apparatus arranged to utilise reciprocating motion between an elongate member and a frame of a pogo stick to which the firing apparatus is, in use, attached to expel liquid in a container mounted on the pogo stick from the pogo stick.

The firing apparatus may comprise a pump.

The kit of parts may comprise electricity generation and storage apparatus. The electricity generation apparatus is arranged to generate electrical energy from the reciprocating motion between the elongate member and the frame.

The kit of parts may additionally comprise memory and/or one or more sensors, transmitters, receivers, transceivers, lights, buzzers or displays arranged to be powered by the generated electricity.

According to a fourth aspect of the invention, there is provided a pogo stick having electricity generation and storage capabilities.

The pogo stick comprises: a frame; an elongate member in sprung connection with the frame, for reciprocating motion between the elongate member and the frame; electricity-generating apparatus connected to the frame and arranged to utilise reciprocating motion between the elongate member and the frame to generate electricity; and an energy storage device connected to the frame and arranged to store the generated electricity.

According to a fifth aspect of the invention, there is provided a kit of parts for modifying a pogo stick to have electricity generation and storage capabilities.

The kit of parts comprises: electricity-generating apparatus arranged to be connected to a frame of a pogo stick and to utilise reciprocating motion between an elongate member and a frame of the pogo stick to which it is, in use, connected to generate electricity; and an energy storage device arranged to store the generated energy.

The electricity-generating apparatus may comprise one or more electricity-generating shock absorbers, such as the linear motion electric power generator disclosed in U.S. Pat. No. 5,347,186 (A).

The energy storage device may comprise one or more batteries and/or capacitors.

The kit of parts may further comprise one or more of the following, arranged to be powered by the generated electricity:

(i) memory;
(ii) one or more sensors (e.g. for remaining liquid level and/or energy expenditure by a user);
(iii) one or more transmitters;
(iv) one or more receivers (e.g. GPS receivers, or a receiver for communication with a remote electronic device);
(v) one or more transceivers;
(vi) one or more lights;
(vii) one or more buzzers (e.g. a low liquid level alarm); and/or
(viii) one or more displays (e.g. screens).

The kit of parts may also comprise water firing apparatus as described in relation to the third aspect of the invention. In embodiments with a display, the display may show sensor data and/or alerts.

Features described in relation to one of the above aspects of the invention may be applied, mutatis mutandis, to the other aspect of the invention. Further, the features described may be applied to the or each aspect in any combination.

There now follows by way of example only a detailed description of embodiments of the present invention with reference to the accompanying drawings in which.

Figure 6A:
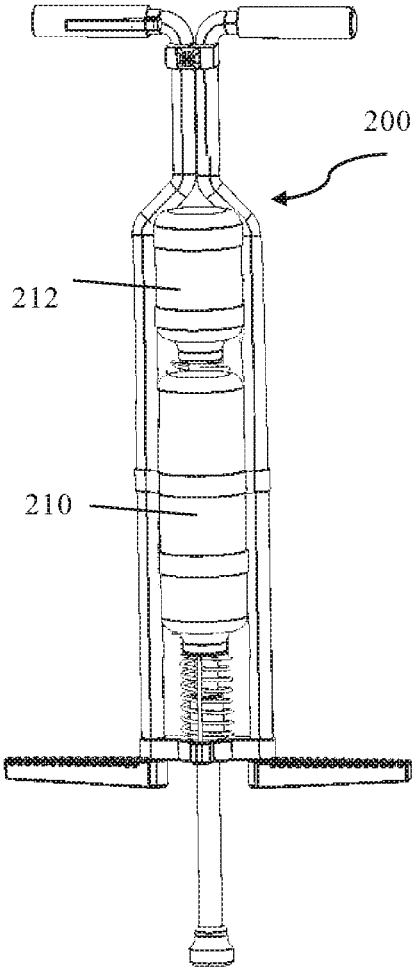
Figure 6B:
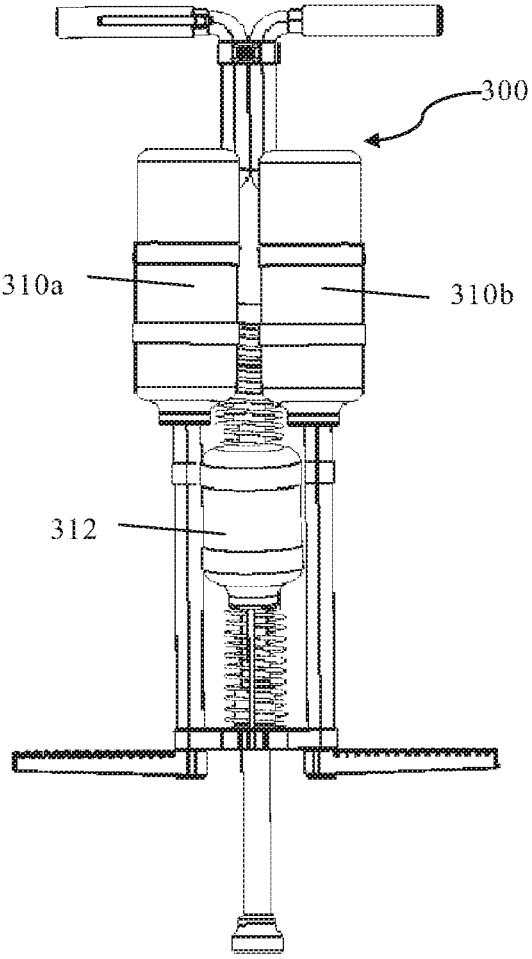
Figure 7:
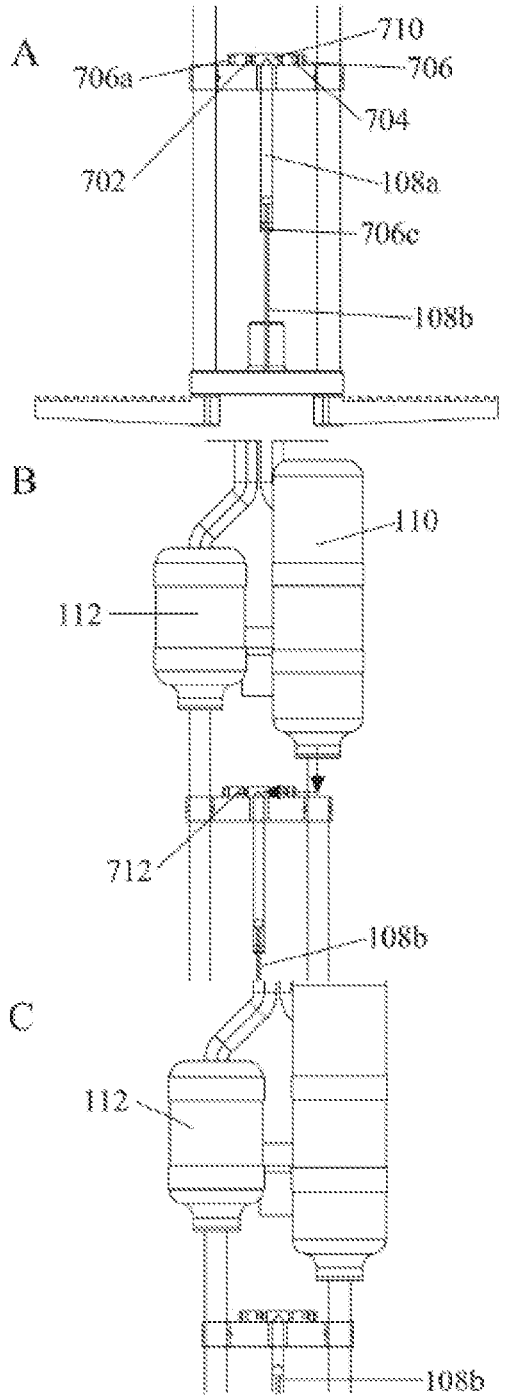
Figure 9A:
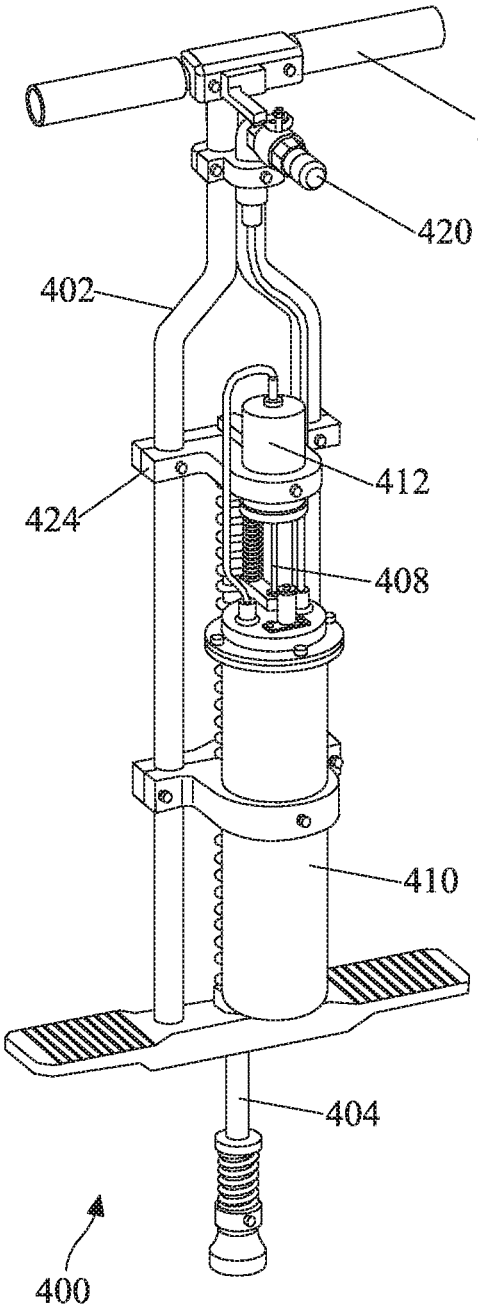
Figure 9B:
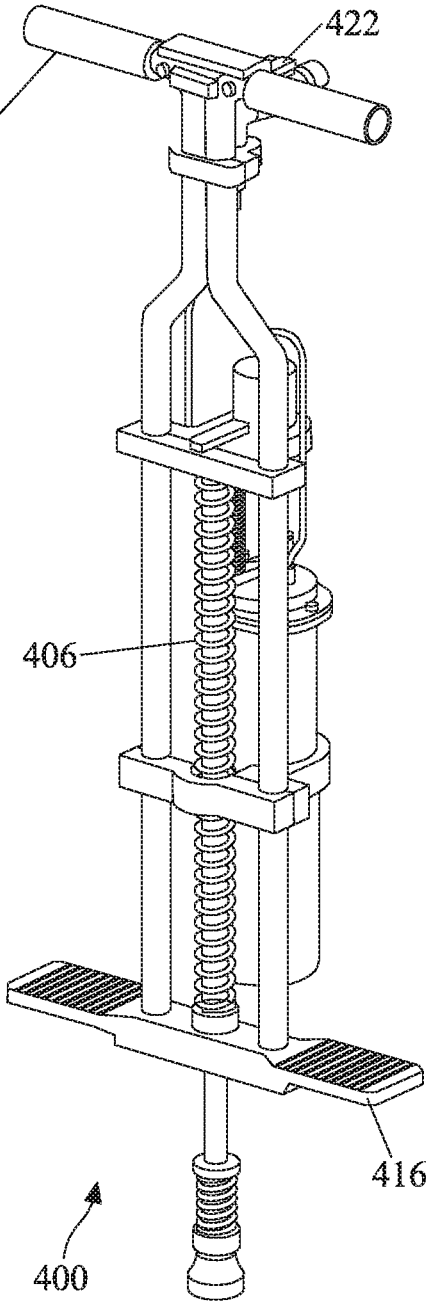
Figure 10:
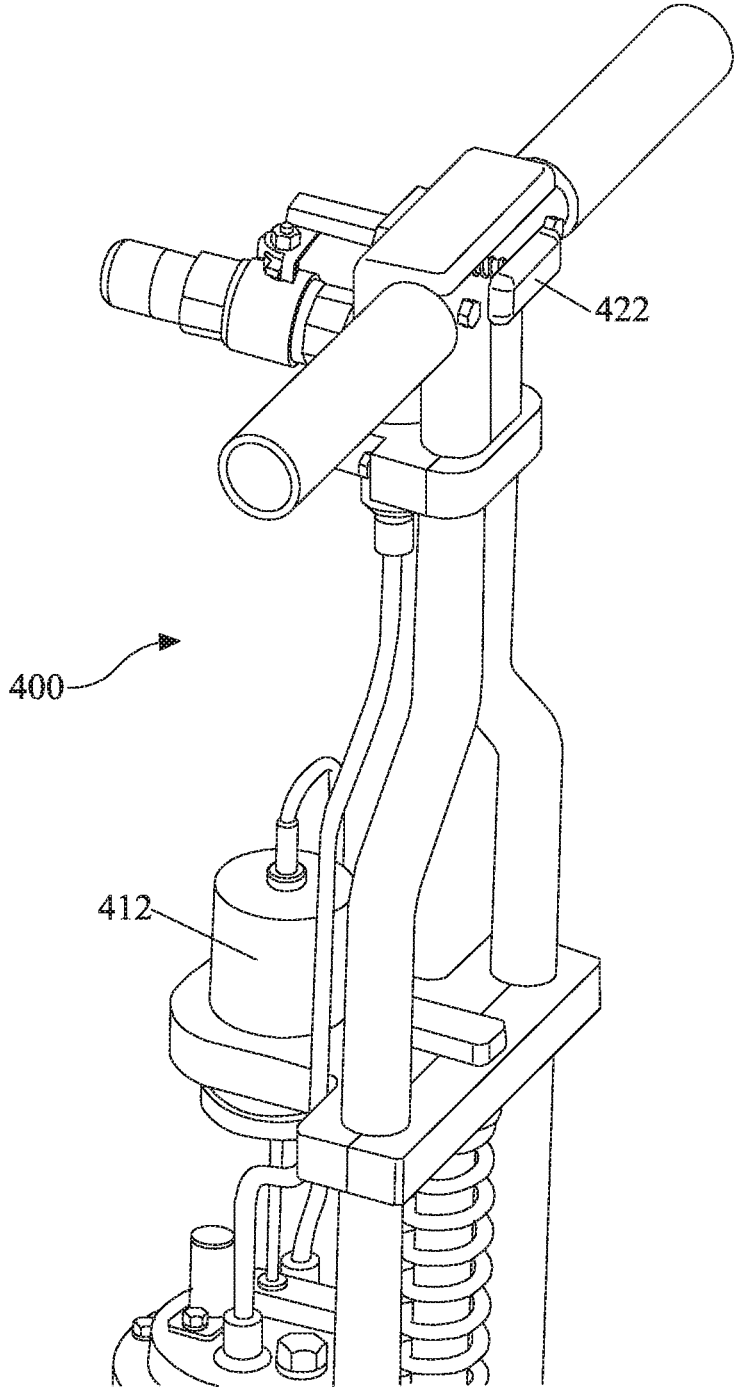
Figure 11:
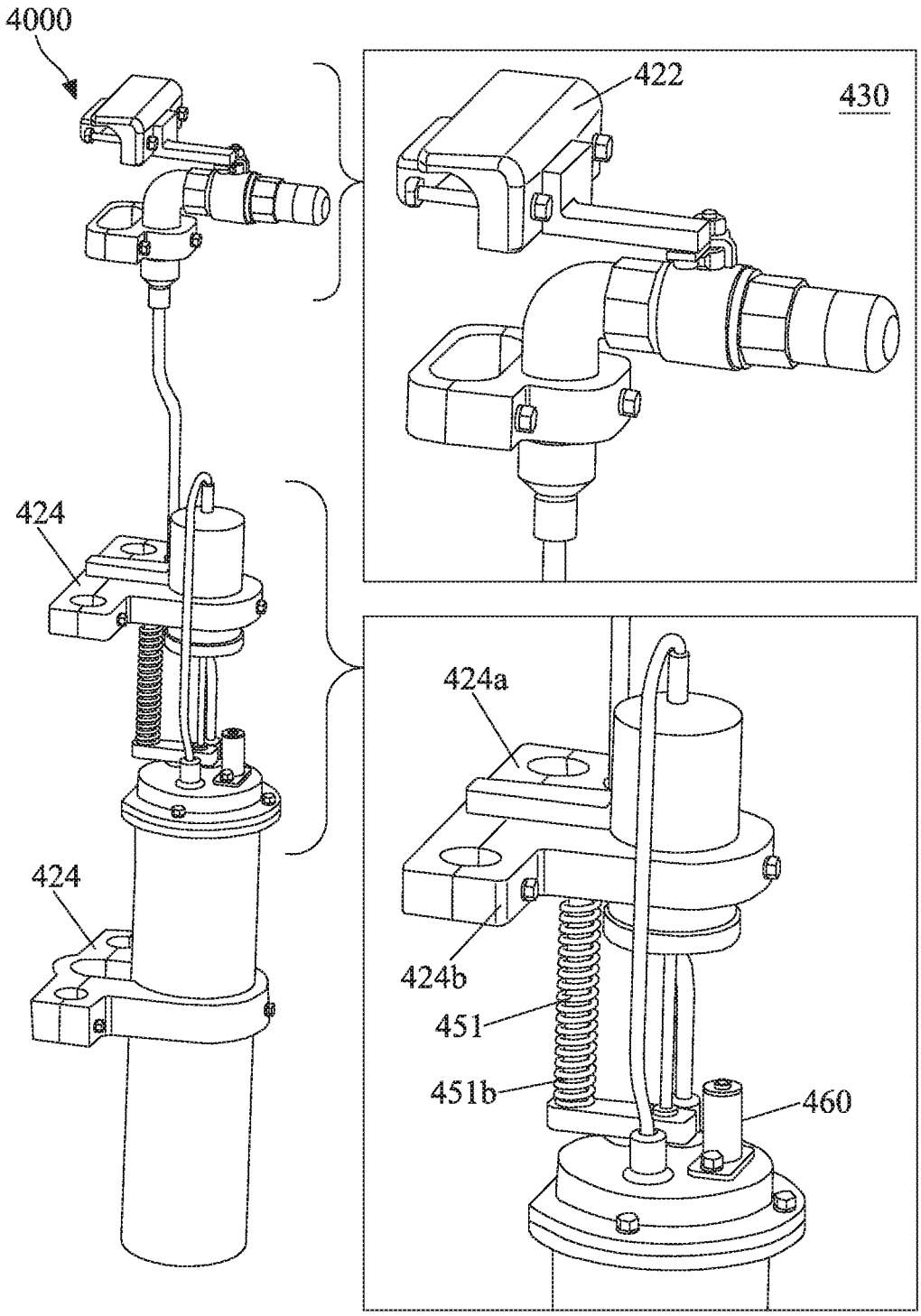
Figure 12:
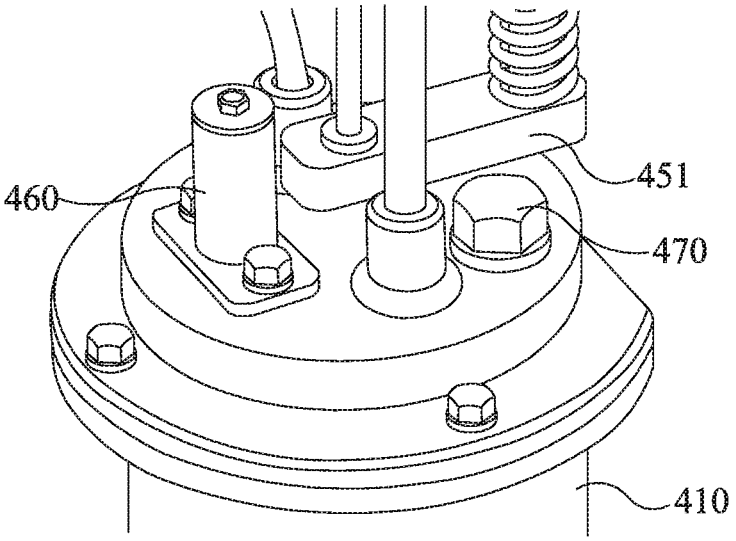
Figure 13A:
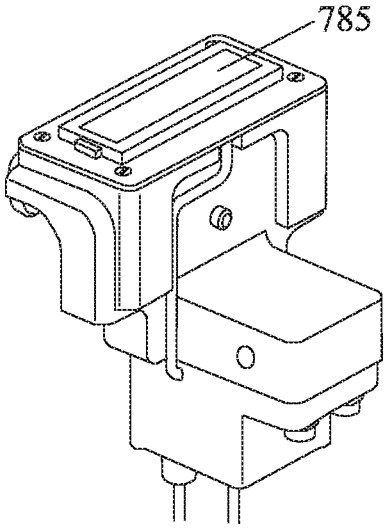
Figure 13B:
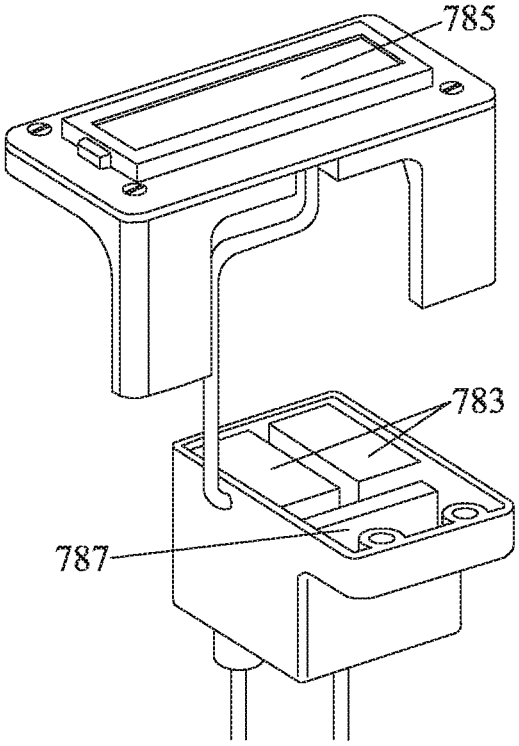
Figure 14:
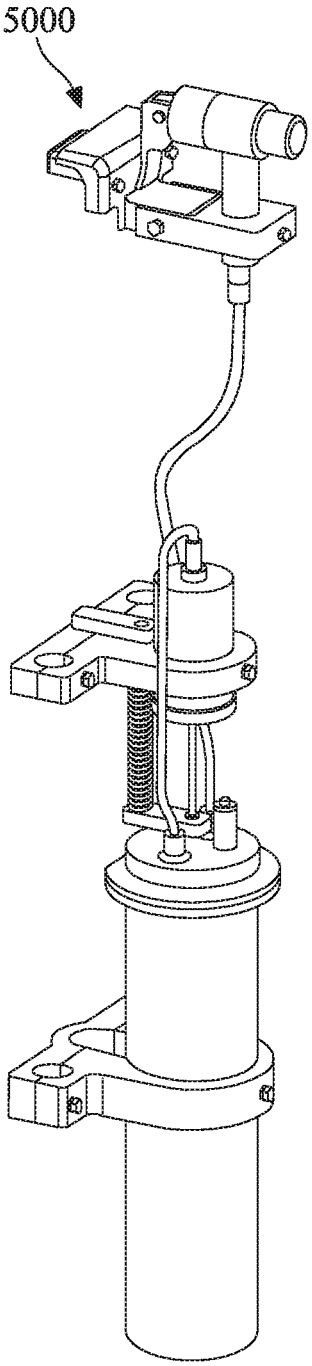
Figure 15:
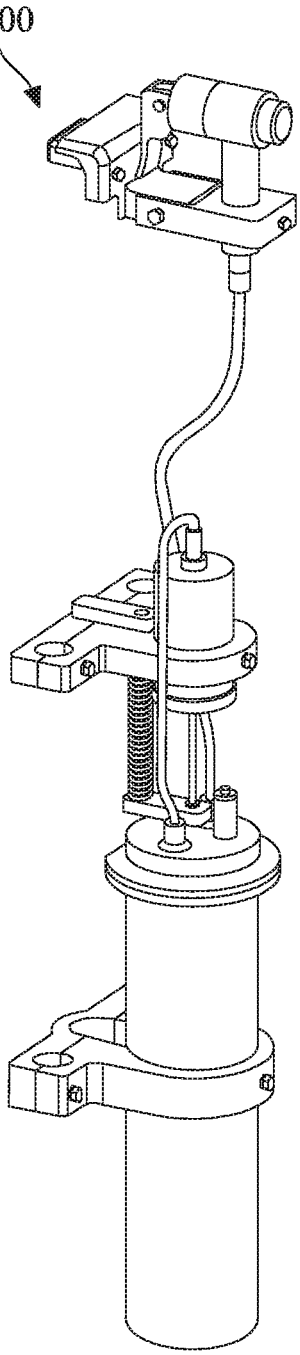
Figure 16:
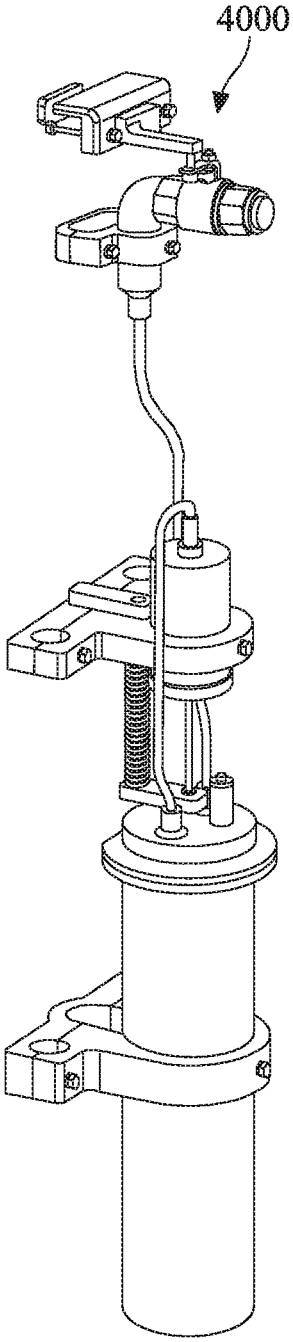
Figure 17A:
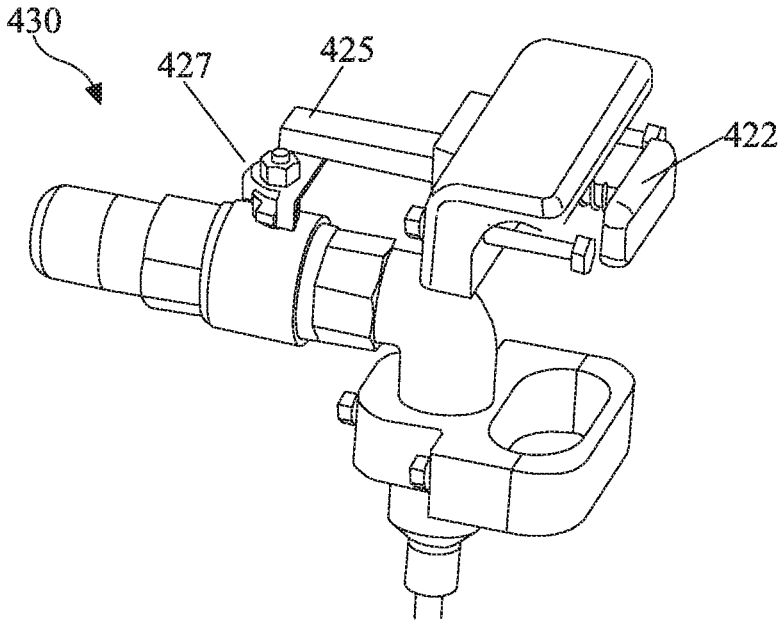
Figure 17B:
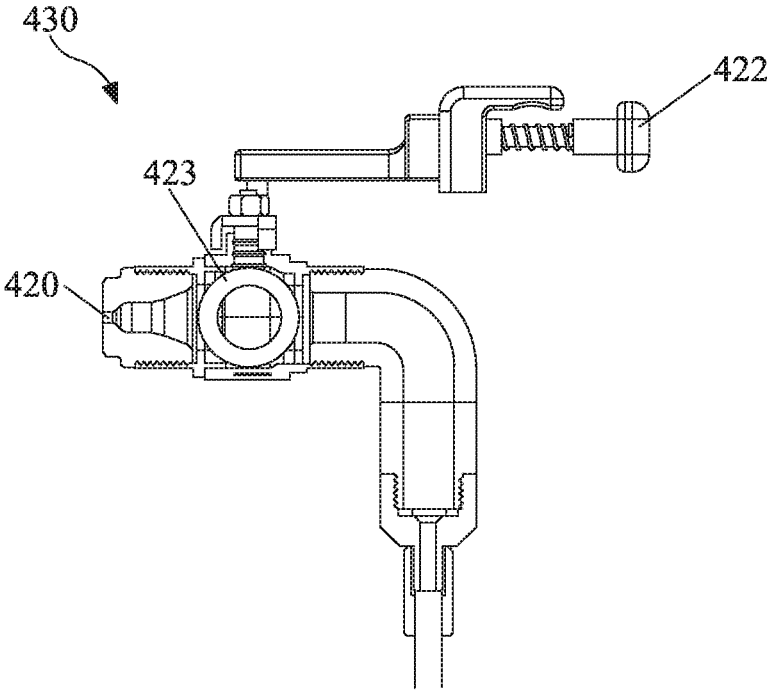
Figure 18:
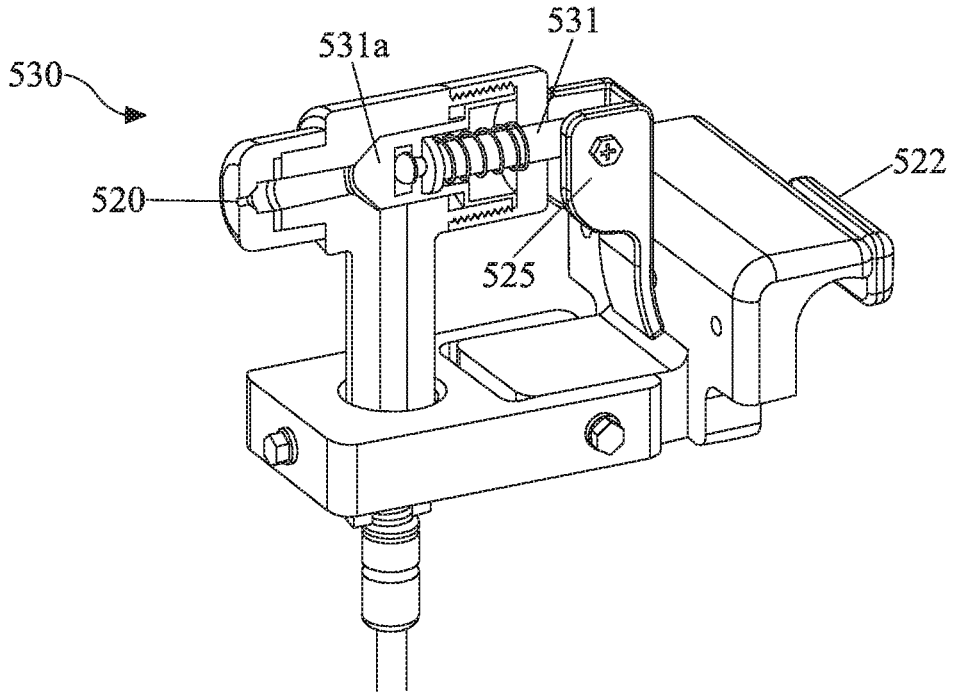
Figure 19:
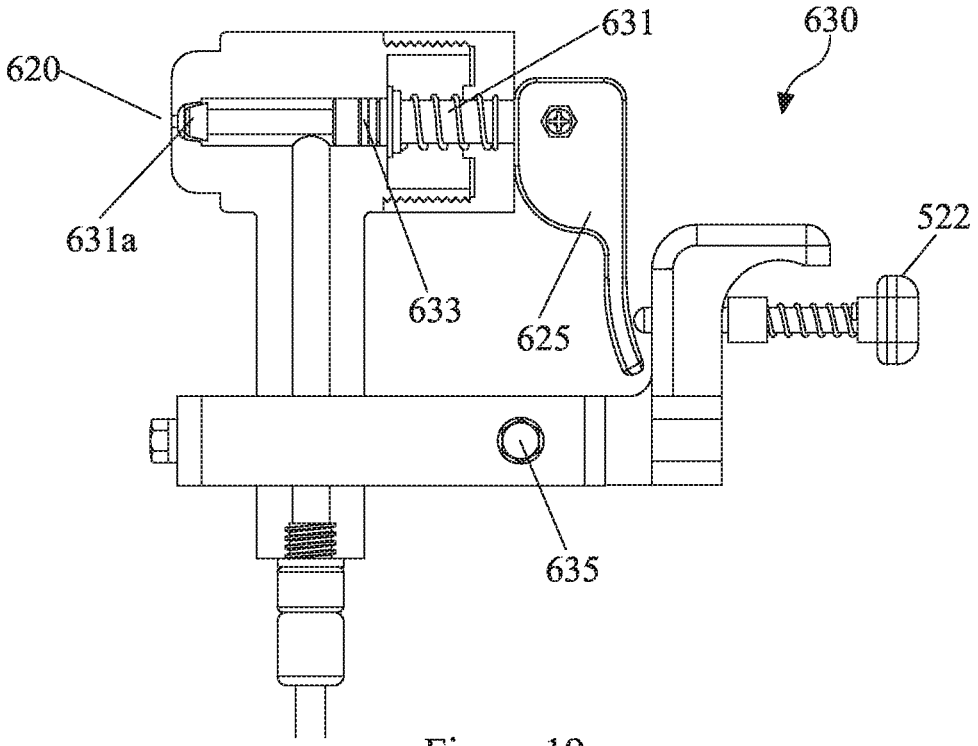
Figure 20:
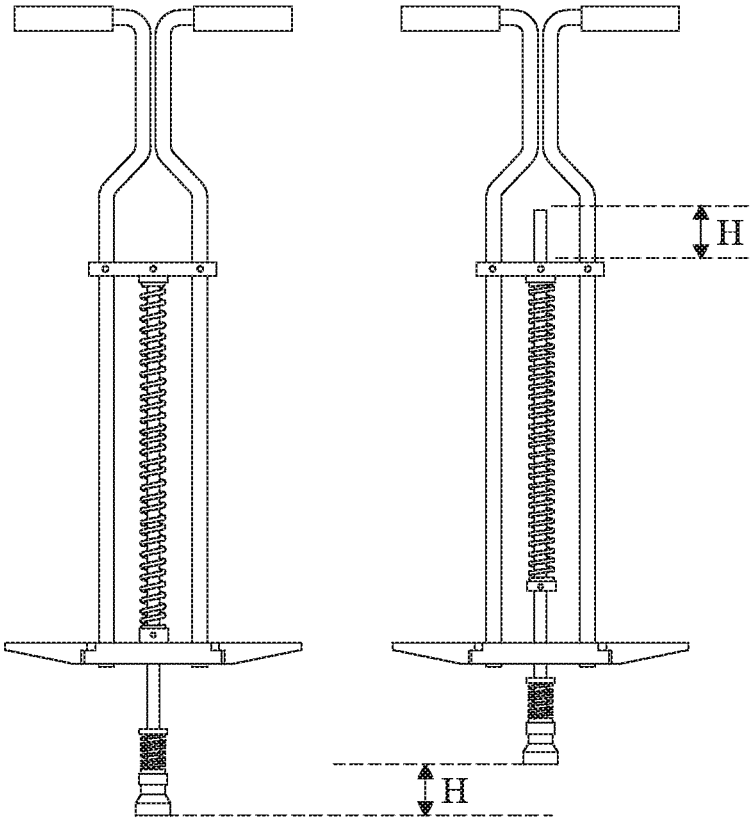
Figure 21:
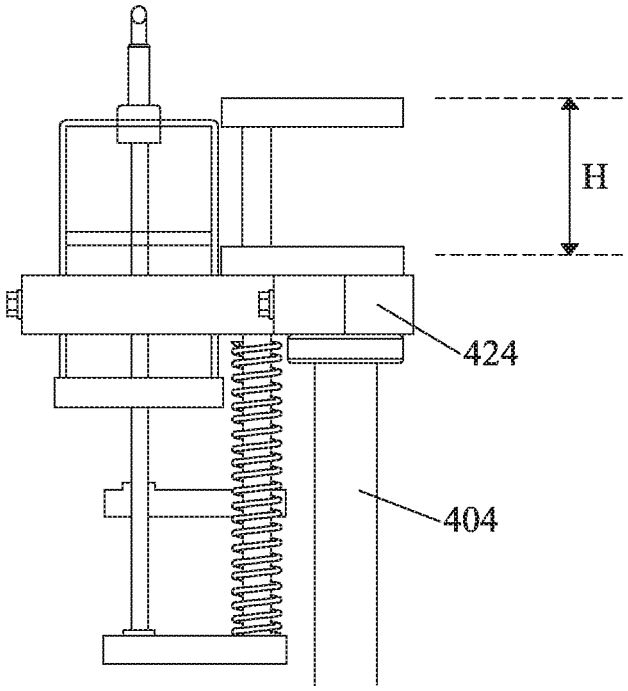
Figure 22:
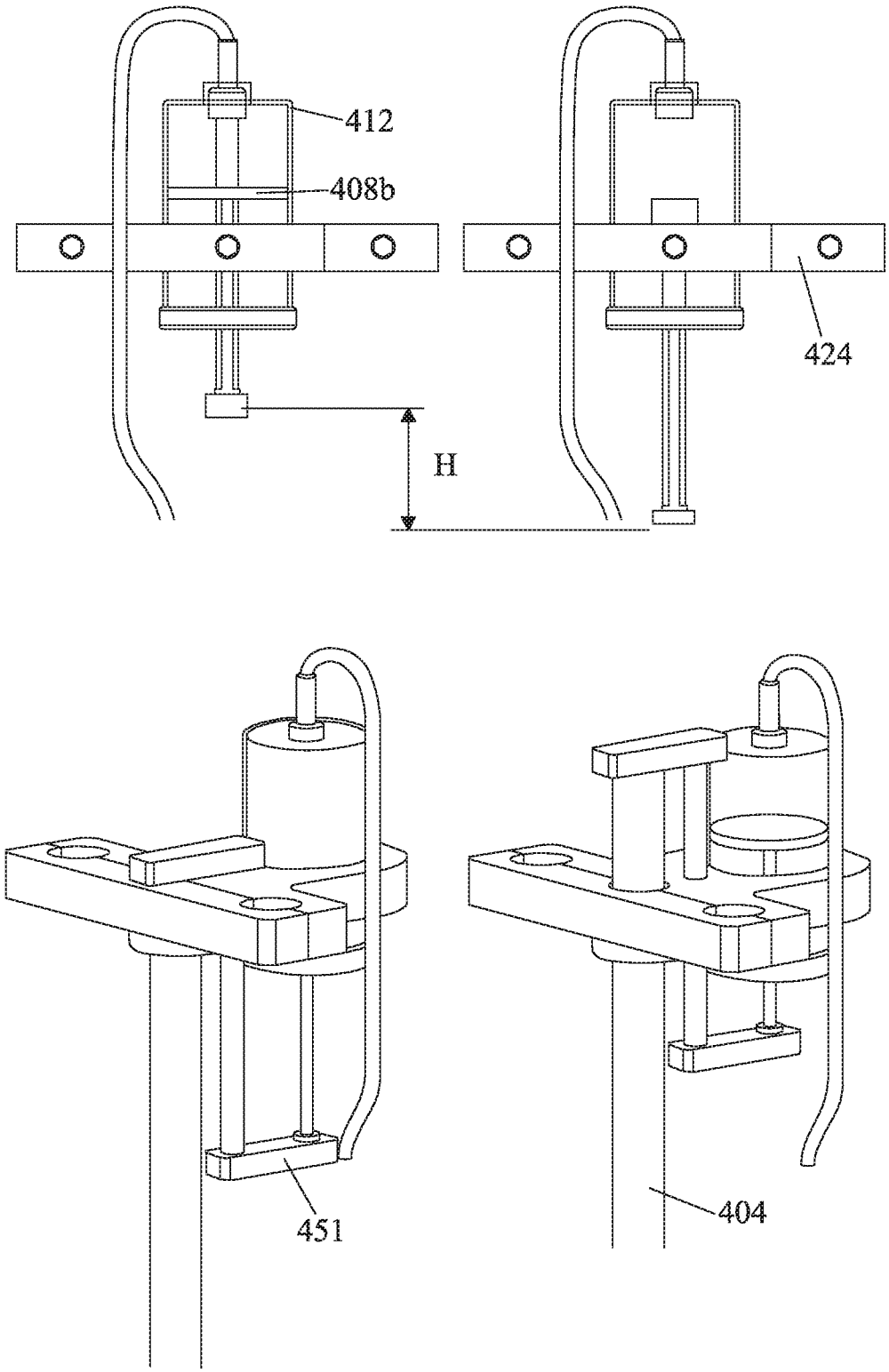
Figures 23A, 23B:
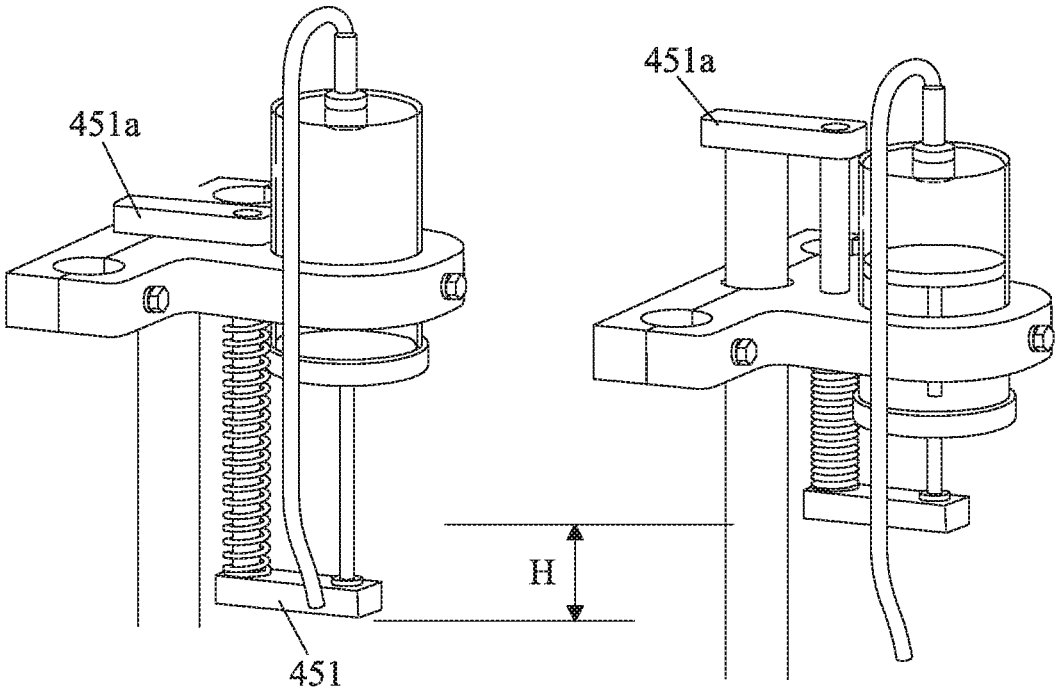
Figure 24:
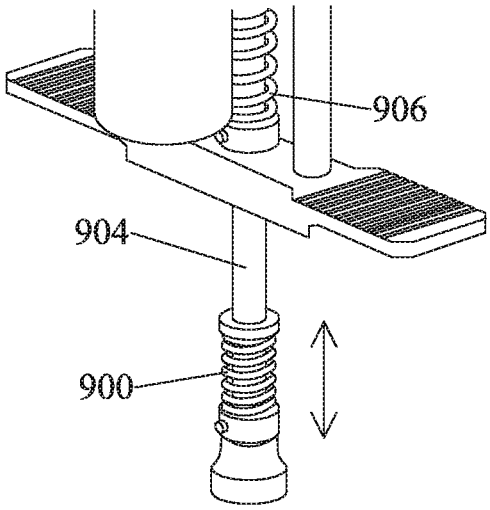
Figure 25:
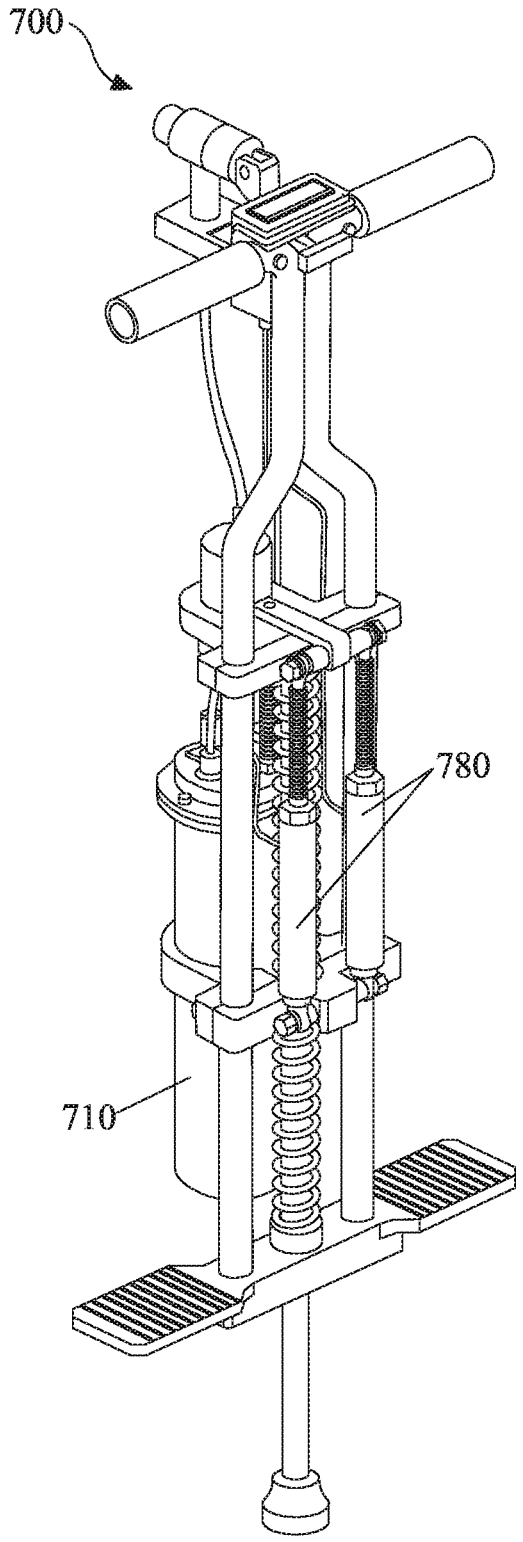
Figure 26:
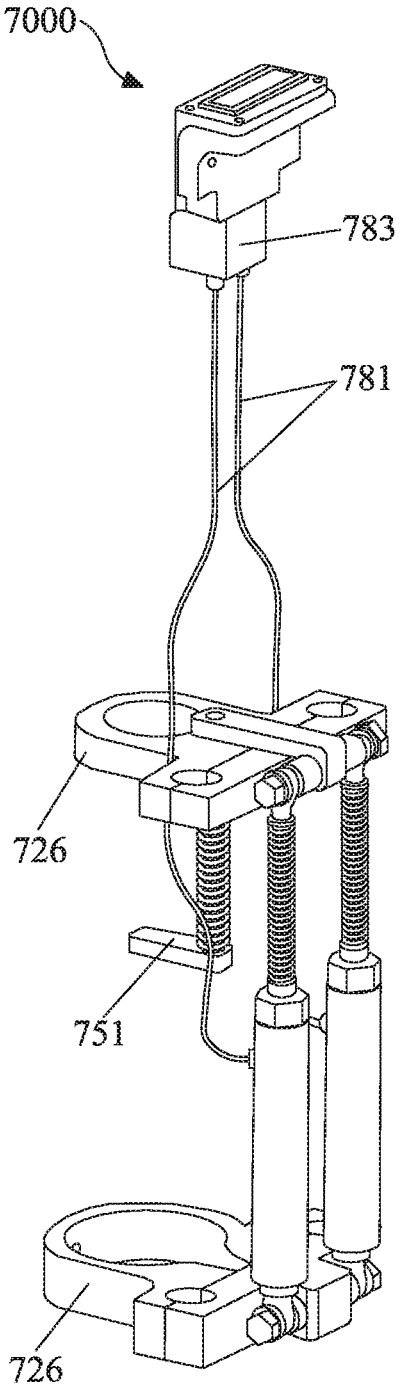

FIGS. 6A and 6B each show an alternative embodiment in which the arrangement of the containers is different;

FIG. 7 shows a valve arrangement of an embodiment;

FIG. 8 shows details of a compressible fluid container of an embodiment;

FIGS. 9A and 9B show two views of a pogo stick of an alternative embodiment;

FIG. 10 shows a close-up of a portion of the pogo stick shown in FIGS. 9A and 9B;

FIG. 11 shows a kit of parts which can be used to convert a prior art pogo stick into a pogo stick equivalent to that shown in FIGS. 9A, 9B and 10;

FIG. 12 shows a close-up of the top of the liquid container shown in FIGS. 9A, 9B, 10 and 11;

FIGS. 13A and 13B show a "smart sport" device for use with any of the pogo sticks described herein;

FIGS. 14 to 16 show three examples of kits of parts which can be used to convert a prior art pogo stick into a water-firing pogo stick;

FIGS. 17A and 17B show the firing apparatus of the kit shown in FIG. 16;

FIG. 18 shows the firing apparatus of the kit shown in FIG. 14;

FIG. 19 shows the firing apparatus of the kit shown in FIG. 15;

FIG. 20 shows the displacement of the elongate member relative to the frame in use;

FIG. 21 shows an example of a pumping mechanism for use with various embodiments;

FIG. 22 shows an alternative example of a pumping mechanism for use with various embodiments;

FIG. 23 shows the action of the pumping mechanism of FIG. 21;

FIG. 24 shows an additional spring for use with various embodiments;

FIG. 25 shows a pogo stick of an embodiment of the invention with electricity-generating apparatus and an integral "smart sport" device as shown in FIGS. 13A and 13B; and FIG. 26 shows a kit of parts for converting a prior art pogo stick into a pogo stick with the energy generation and "smart sport" capabilities of the pogo stick shown in FIG. 25.

In the figures, like reference numerals are used for like components.

Figures 1A, 1B, 1C:
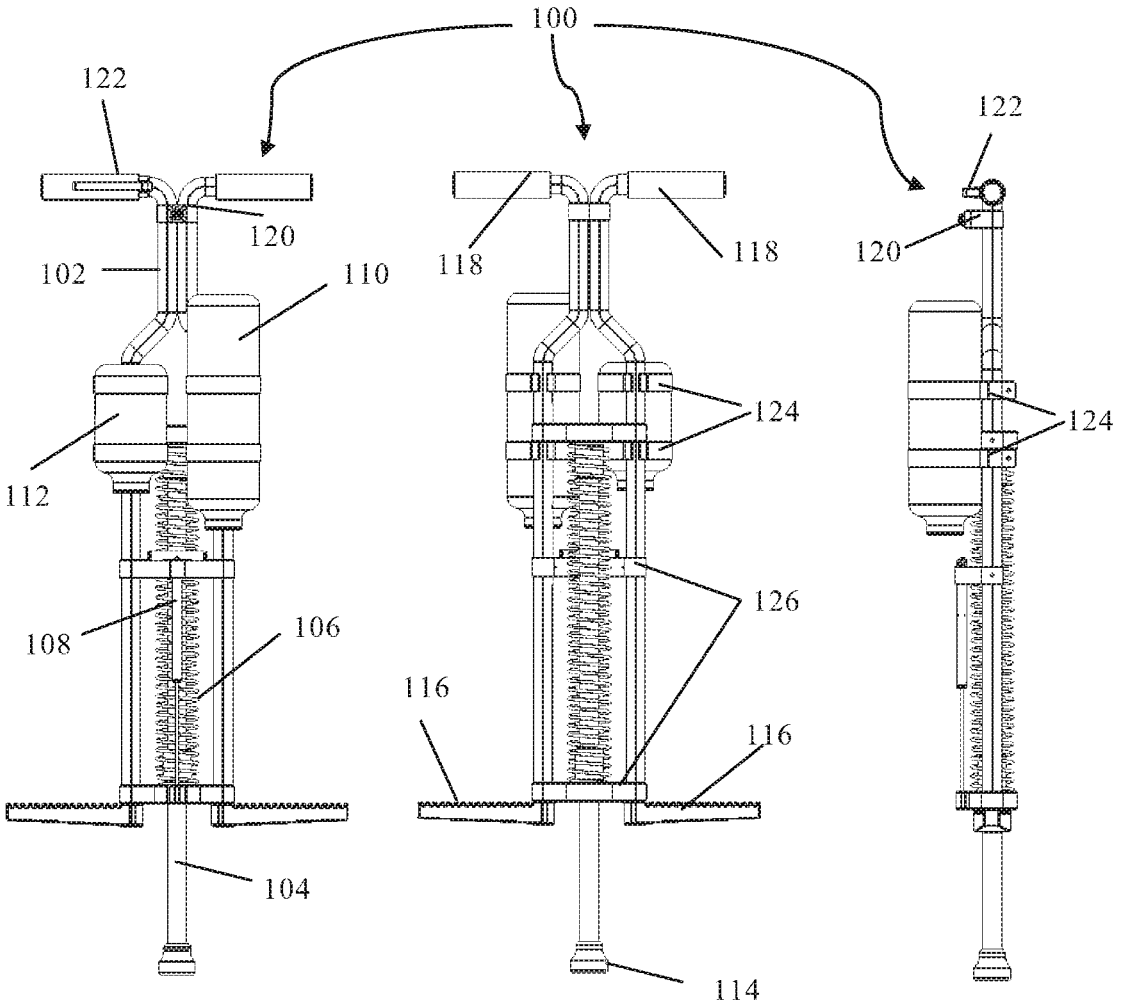
FIGS. 1A to 1C show a pogo stick of an embodiment from three different perspectives.
Figure 2:
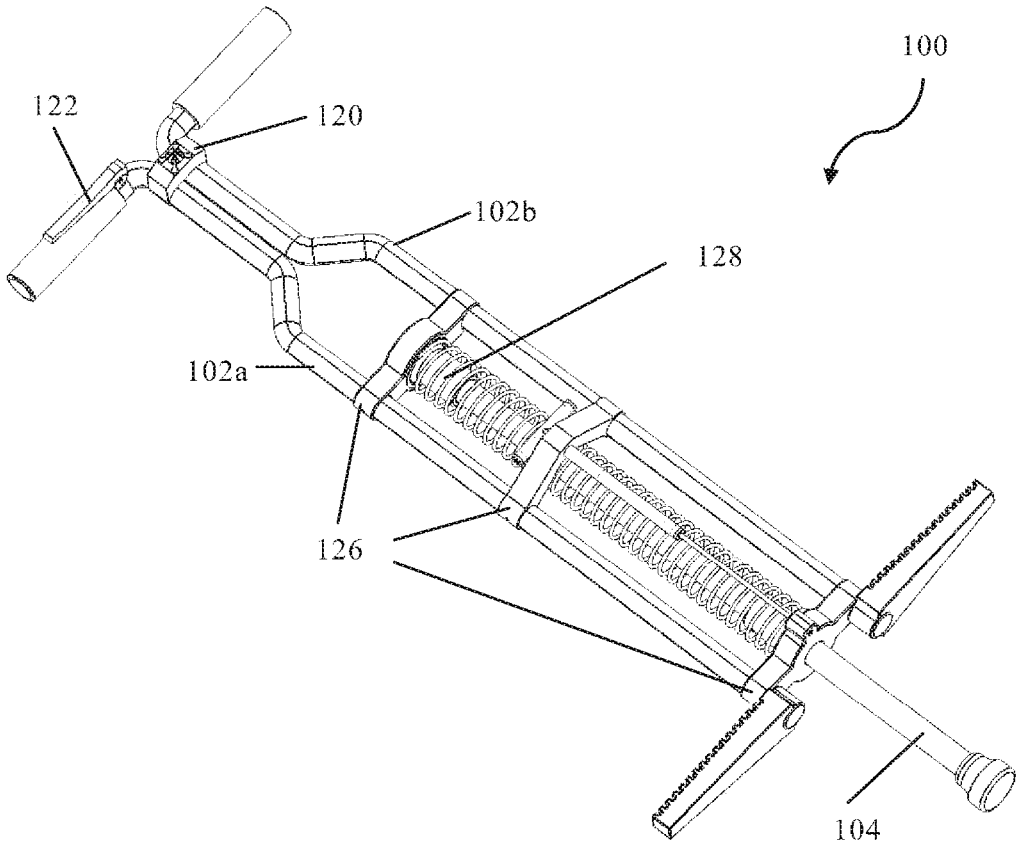
FIG. 2 shows the pogo stick of FIGS. 1A-C with the containers removed.
Figure 3:
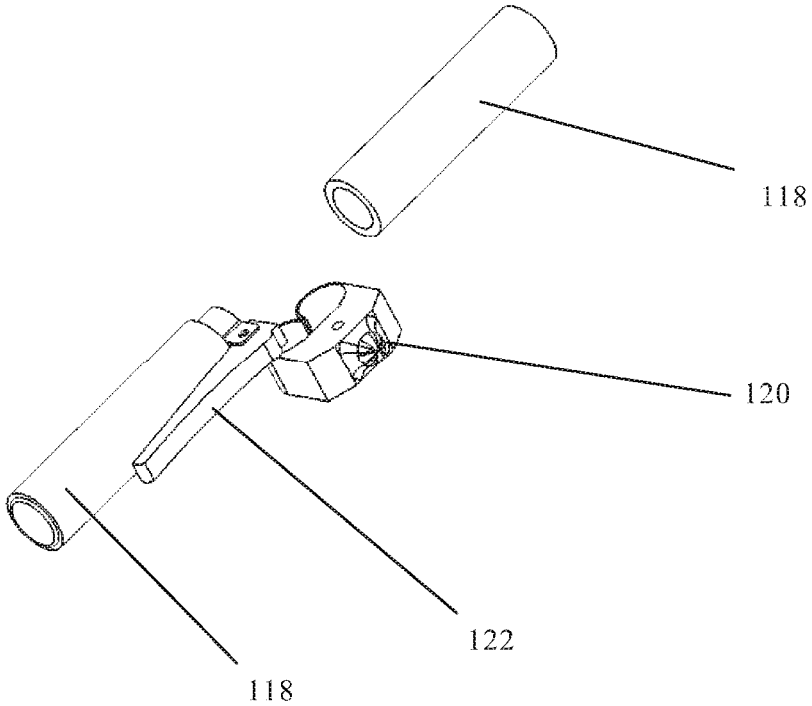
FIG. 3 shows a close-up of the trigger and firing nozzle of the pogo stick.
Figure 4:
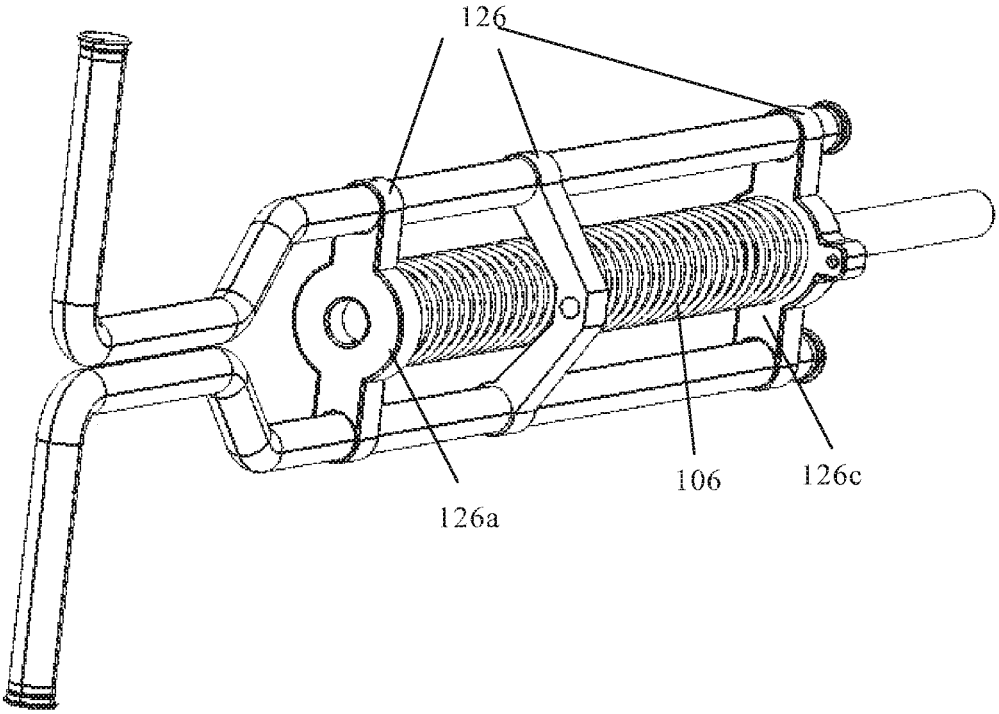
FIG. 4 shows a close-up of a portion of the pogo stick.
Figure 5:
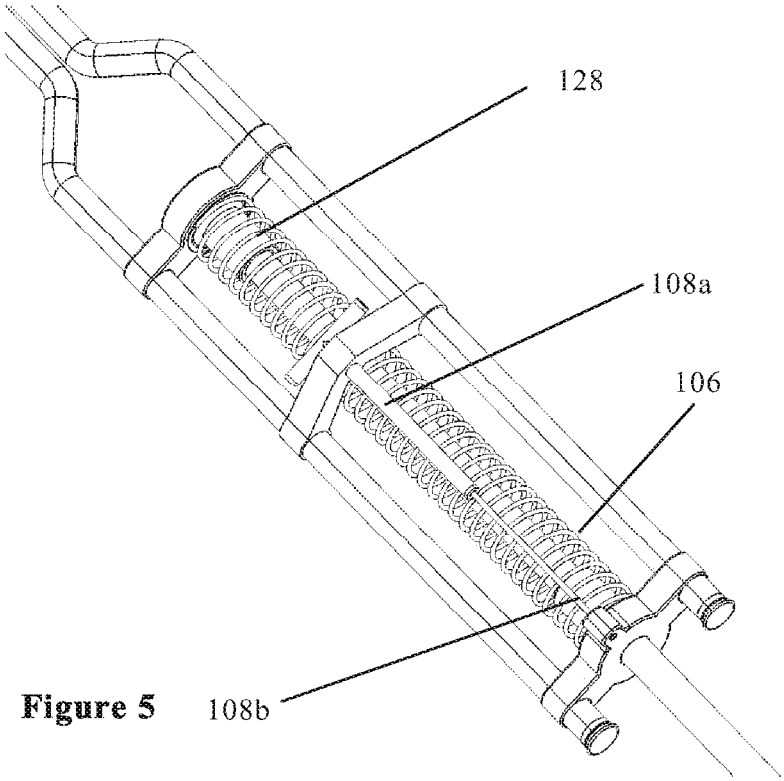
FIG. 5 shows a close-up of a different portion of the pogo stick.

As shown in FIGS. 1A-C, in a first embodiment of the invention the pogo stick 100 comprises a frame 102. The frame 102 is made of metal or another suitable material, for example plastic, a composite material or the like. In this embodiment, the frame 102 comprises two arms 102*a* and 102*b* which are substantially parallel to each other and rigidly connected by means of connectors 126. In alternative embodiments, the two arms 102*a*, 102*b* may be replaced with a single, forked component.

In this embodiment, each of the two arms 102*a*, 102*b* forms a handle 118 at what is, in use, the top of the pogo stick 100. The handle 118 may be covered with foam, rubber, plastic, or another material. Advantageously, the covering material provides a comfortable grip. In alternative embodiments, the handles 118 may be separate components attached to the frame 102.

In this embodiment, the arms 102*a*, 102*b* are in contact near the top of the pogo stick 100, and then separate whilst remaining substantially parallel, such that the arms 102*a*, 102*b* of the frame 102 are spaced at the lower end of the pogo stick 100. The skilled person would therefore understand that the connectors 126 further down the pogo stick are therefore longer so as to allow for space between the arms 102*a*, 102*b*.

The frame 102 is connected to an elongate member 104. In this embodiment, the elongate member 104 is a pole oriented substantially parallel to the frame 102. The elongate member is located between the arms 102*a*, 102*b* of the frame 102, extending beyond the lower extent of the frame 102.

In this embodiment, the elongate member 104 is connected to the frame 102 by a spring 106. The spring 106 is attached to the frame 102 at its upper end and to the elongate member 104 at its lower end. In alternative or additional embodiments, a compressible rubber, or other resilient material or form which compresses under pressure and rebounds towards its original shape on removal of the pressure may be used in place of, or in addition to, a spring. In the embodiment shown, the spring 106 is coiled around the elongate member 104; in other embodiments, the spring could be substantially parallel to the elongate member 104 without being coiled around it.

One or more guides may be provided to maintain a position of the elongate member 104 with respect to the frame 102. A stop may also be provided to limit the upwards movement of the elongate member 104 with respect to the frame 102.

In the embodiment being described, the connectors 126 provide guides and a stop. The connectors 126 comprise struts between the two arms 102*a*, 102*b* of the frame 102. The connectors 126 may have an aperture, bend or curve to avoid contact with the spring 106. The connectors may be made of any suitable material, for example plastic, metal, or a composite material.

In this embodiment, the elongate member 104 passes within two of the three connectors 126. Connectors 126*b* and 126*c* therefore serve as guides for the elongate member 104, advantageously helping to keep the elongate member 104 in position. Further, connector 126*a* serves as a stop, marking the highest point with respect to the frame 102 that the elongate member 104 can reach.

Connector 126*c* is a guide for the elongate member 104. The guide 126*c* comprises a hole shaped to allow the elongate member 104 to pass therethrough. In the embodiment shown in the Figures, the hole is circular and substantially the same size as the cross-section of the elongate member 104, so allowing the elongate member 104 to move through the hole in a vertical direction without permitting significant horizontal motion.

Connector 126*a* blocks further upward movement of the elongate member 104, so serving as a stop.

In other embodiments, more or fewer connectors 126 may be used and none, some or all of the connectors may act as guide members 126*a*, 126*b*. In embodiments where connectors 126 are not used as guide members, additional guide members for the elongate member 104 may be provided. Further, one or more of the connectors 126 or guide members may be integral with the frame instead of being separate components.

In the embodiment being described, the pogo stick 100 further includes a resilient member 128 between the upper guide member 126*a* and the upper end of the elongate member 104. The resilient member 128 may advantageously cushion the impact of the elongate member 104 on the guide member 126*a* during reciprocating motion. In the embodiment being described, the resilient member 128 further advantageously serves to hold the upper end of the spring 106 in position.

In the embodiment being described, the pogo stick further comprises footrests 116 connected to the frame 102. The footrests 116 are located at the lower end of the pogo stick 100. The elongate member 104 extends beyond the footrests 116.

The upper surfaces of the footrests 116 may be corrugated, ridged, grooved or otherwise shaped or coated to improve grip. The footrests 116 may be made of moulded plastic, cast aluminium or any other suitable material known to one skilled in the art.

In this embodiment, two separate footrests 116 are provided. In alternative embodiments, both footrests may be provided as a single piece. In some embodiments, a single footrest, for example shaped like a ring, square plate or the like around the frame 102, may be provided. The skilled person would understand that many different footrest designs may be used.

In alternative or additional embodiments, the footrests 116 may be integral with the frame 102.

In this embodiment, the pogo stick 100 further comprises a foot 114 at the lower end of the elongate member 104. The foot 114 is arranged, in use, to make contact with the ground. In this embodiment, the foot 114 is made of rubber; another resilient material, or a combination of materials, may also be used.

In some embodiments (not shown), the foot 114 is a stabilising foot, arranged to allow a user to balance on the pogo stick 100 in an upright position. In some such embodiments, the stabilising foot may be sufficiently broad that a user may balance on the pogo stick 100 in a stationary upright position. In other such embodiments, the stabilising foot may comprise a central foot 114 and projections which contact the ground around the central foot 114, for example in the form of a tripod. The skilled person would understand that 1, 2, 3, 4 or more projections may be provided, and that many different shapes may be used. Advantageously, use of a stabilising foot 114 allows the pogo stick 100 to be used as a stationary firing turret.

The pogo stick further comprises a container 110 arranged to contain a liquid. The position of the liquid container 110 may be different in different embodiments, as illustrated in FIG. 6 and described in more detail below. The liquid container 110 may be relatively heavy when full, so location of the liquid container 110 may affect balance.

Multiple liquid containers 110 may be used in some embodiments. Advantageously, spreading the weight between multiple containers may assist with balance.

The pogo stick further comprises a container 112 arranged to contain a compressible fluid. In the embodiment being described, the compressible fluid is a gas, and more specifically air. The skilled person would understand that other compressible fluids could be used.

The position of the gas container 112 may be different in different embodiments, as illustrated in FIG. 6.

In the embodiment shown in FIG. 6A, the pogo stick 200 has a single gas container 212 and a single liquid container 210, both containers being arranged along the central line of the frame 102. In the embodiment shown, the liquid container 210 is located below the gas container 212. Advantageously, this arrangement lowers the centre of mass, so potentially improving balance. However the positions of the liquid container and the gas container could be reversed in alternative embodiments.

In the embodiment shown in FIG. 6B, the pogo stick 300 has a single gas container 312 and two liquid containers 310*a*, 310*b*. In the embodiment shown, the liquid containers 310*a*, 310*b* are located above the gas container 312.

In the described embodiments, one or more container mounts 124 may be provided per container 110, 112, 210, 212, 310*a,b*, 312. In the described embodiments, the container mounts 124 secure the containers 110, 112 to the frame 102.

The container mounts 124 may be sprung and/or may comprise clips, buckles, Velcro® or another hook-and-eye fastener, zips or buttons (not shown) to allow one or both of the containers 110, 112 to be removed and reattached. Advantageously, this may facilitate refilling of the liquid container 110. The skilled person would also understand that liquid containers 112 of different sizes could be attached—advantageously, this would allow a user to obtain familiarity with balancing with a smaller, lighter container before attaching a larger, heavier container with a greater liquid capacity. Further advantageously, some or all of the containers 110, 112 may be removed if a user so wishes, so allowing the pogo stick 100 to be used as a normal pogo stick, without water firing capabilities.

The pogo stick 100 further comprises firing apparatus arranged to expel the liquid from the pogo stick.

In this embodiment, the firing apparatus comprises a pump 108. The pump 108 is arranged, in use, to pressurise the gas within the gas container 112. The pump 108 comprises two sections; a piston 108*b* and a compression chamber 108*a*.

In this embodiment, the compression chamber 108*a* of the pump 108 is T-shaped and is connected to the frame 102 and the piston 108*b* is connected to the elongate member 104. Relative motion of the frame 102 and the elongate member 104 activates the pump 108. The skilled person would understand that, in use, relative motion is provided by a user bouncing up and down on the pogo stick 100 in a manner well known in the art of pogo sticks. The relative motion may be described as reciprocating motion; the elongate member 104 moves backwards and forwards with respect to the frame 102, along the vertical axis of the pogo stick 100 as shown in FIG. 1.

In alternative embodiments, the compression chamber 108*a* of the pump 108 may be connected to the elongate member 104 and the piston 108*b* may be connected to the frame 102. Further, pumps 108 of many different shapes may be conceived.

In additional or alternative embodiments, the compression chamber 108*a* may be integral with the frame 102, and the piston 108*b* may be integral with the elongate member 104, or vice versa.

FIG. 7 shows the pump 108 of the embodiment being described in more detail. The compression chamber 108*a* of the pump 108 is connected to the gas container 112 by a conduit (not shown). The pump 108 comprises a compression chamber 108*a* which is T-shaped, two valve balls 702, 704, two springs (not pictured), a connecting rod (piston 108*b*) and three end caps 706*a,b,c* which are attached after the valve balls and springs have been inserted.

In the rest state, the pump 108 is as shown in FIG. 7A. The pump 108 has two check valves 710, 712 which allow liquid to flow from right to left only, in the orientation shown. The first check valve, 710, is pulled downwards by the vacuum created during downwards motion of the piston/connecting rod 108*b*. The downward motion is created when the pogo stick spring 106 is allowed to "rest"/extend, when the pogo stick 100 is in mid-air/mid-jump, i.e. when there is no weight on the elongate member 104.

In the rest state (FIG. 7A), the check valve 710 compresses its spring enough to allow liquid from the liquid container 110 to flow into the valve 710 (pipes not shown). The movement of the liquid is shown in FIG. 7B.

As the spring 106 is compressed when a user hits the ground with the pogo stick 100, the connecting rod/piston 108*b* is made to move upwards within the compression chamber 108*a*. The resultant increased pressure within the compression chamber 108*a* closes the check valve 710. The increased pressure then opens the second check valve 712.

The liquid within the compression chamber 108*a* is then forced to enter the gas container 112. The gas container 112 may be referred to as a pressure reservoir, as, in use, it contains both gas and liquid in such embodiments. The liquid entering the gas container 112 causes the air inside the top of the gas container to compress. The movement of liquid causing the compression of gas inside the gas container 112 provides power to force the liquid within the gas container 112 out of an outlet 120 located on the frame 102 of the pogo stick 100. In the embodiment being described, the outlet 120 is a nozzle.

The skilled person would understand that a moveable separator may be provided within the gas container 112 to separate the liquid and the gas, thereby preventing escape of the gas when the liquid is ejected. The compressed gas applies a force to the separator, which moves downwards within the container 112, so ejecting the liquid, when the pressure is released by the opening of a valve (not shown) between the gas container and the outlet.

Figure 8A:
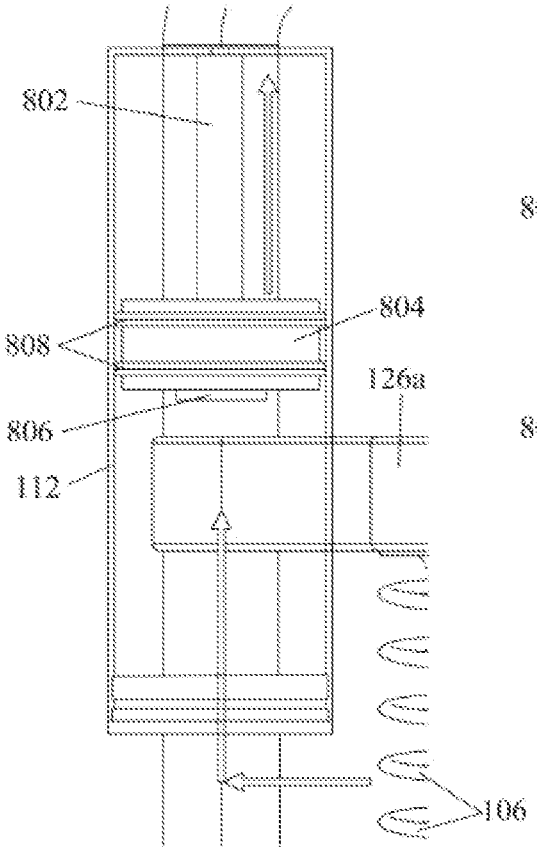
Figure 8B:
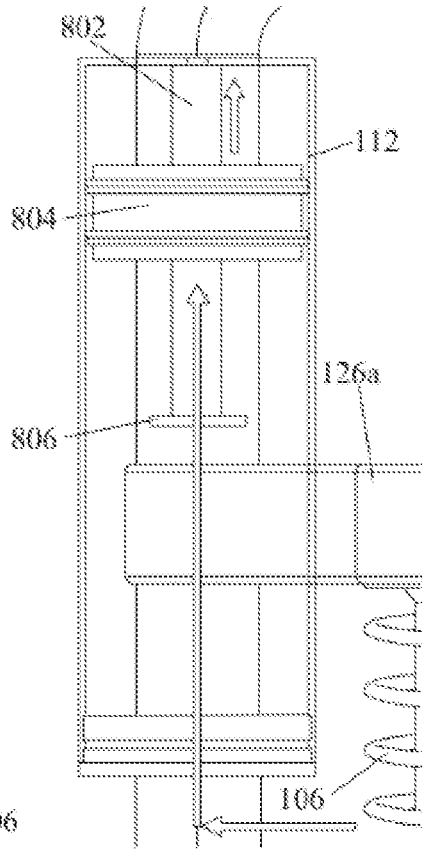

FIGS. 8A and 8B show one example of a moveable separator 804. In this embodiment, the gas container 112 contains a central piston shaft 802 with a piston 804 mounted on it. The piston 804 separates the gas in the top of container 112 from the liquid in the bottom of the container 112. The piston 804 has one or more seals 808; in this embodiment, two K-seals are used. Different seals and different numbers of seals could be used. The seals 808 prevent the gas and liquid from passing the piston 804, so prevent mixing.

A washer 808 and locking bolt prevent the piston 804 from becoming detached from the shaft 802.

The skilled person would understand that different types of separator could be used.

The thicker arrows in FIGS. 8A and 8B represent the liquid from the liquid container 110 entering the gas container 112, as it is pumped into the gas container 112 as described above. As the liquid enters the gas container 112, the piston 804 is pushed upwards, as shown by the thinner arrows. The gas is therefore compressed as the liquid enters the gas container 112.

When the liquid is fired from the pogo stick 100, the pressure is released and the expansion of the compressed gas returns the piston 804 to its initial position at the bottom of the shaft 802. A pipe (not shown) is provided from the lower portion of the gas container 112 which contains liquid to the outlet 120. The pipe is located below the lowest position of the piston, such that the gas cannot escape.

In alternative embodiments, the orientation of the gas container 112 may be reversed such that the gas is stored in a lower portion of the gas container 112, and the piston 804 is pushed downwards when liquid is pumped into the upper portion of the gas container 112.

In the embodiment shown in FIGS. 8A and 8B, the shaft 802 is substantially shorter than the gas container 112. In other embodiments, the shaft 802 may be longer, and may be substantially as long as the gas container 112.

In alternative embodiments, gas within the gas container/pressure reservoir 112 is pressurised by the introduction of more gas into the gas container 112 by the pump 108. Advantageously, the introduced gas is air from the atmosphere, taken in through an intake valve. A tube or pipe (not shown) is provided between the gas container 112 and the liquid container 110 to allow gas from the gas container 112 to move into the liquid container 110 when a valve (not shown) between the two containers 110, 112 is opened. A second tube or pipe (not shown) is provided between the liquid container 110 and an outlet 120 located on the frame 102 of the pogo stick 100. The second pipe allows liquid from the liquid container 110 to be ejected via the outlet 120 when a second valve (not shown) between the liquid container and the outlet is opened. In such embodiments, a separator or membrane (not shown) may be provided within the liquid container 110 to prevent the gas from escaping. The separator may be a piston in some embodiments, as illustrated for the gas container 112 in FIGS. 8A and 8B. In embodiments with a separator/membrane, the separator/membrane is moved by the pressure of the expanding compressed gas, so forcing liquid out of the liquid container 110. In some embodiments, only a single valve may be used between the gas container 112 and the outlet 120.

In further alternative embodiments, the reciprocating motion may directly apply a force to the liquid in the liquid container 110, to expel the liquid therefrom with each bounce. In some such embodiments, the elongate member 104 may comprise, or have connected thereto, a plunger which enters a liquid container 110, so displacing some or all of the liquid, when the elongate member moves upwards with respect to the frame 102. The firing apparatus may therefore not include a pump 108.

Advantageously, use of a compressible fluid facilitates the build-up of pressure over multiple bounces and allows control of when the liquid is fired.

Further advantageously, use of a gas container 112 facilitates reduction of the pressure/venting, if necessary, without ejecting stored liquid. A pressure release valve (not shown) from the gas container 112 may be provided in some embodiments. The pressure release valve may be opened if the pressure build-up within gas container 112 is above a certain threshold, so as to avoid damage to the system (containers 110, 112, pipes, valves, and/or connectors therebetween). In some embodiments, liquid may be vented instead of, or as well as, the gas when the pressure exceeds the threshold.

In at least some embodiments comprising pressure release valves, the vented liquid and/or gas is vented through a different outlet from the outlet 120 through which the liquid is intended to be fired. The vent outlet (not shown) may be located lower down the pogo stick 100 as compared to the outlet 120, and may be directed downwards.

The pogo stick 100 further comprises an outlet 120 in the form of a nozzle. The skilled person would understand that other outlet designs may be envisaged and further that multiple outlets could be provided.

In this embodiment, the outlet nozzle 120 is located centrally on the frame 102, at the height of the handles 118, and directed away from the expected position of a user. The side of the pogo stick 100 on which a user is expected to position him or herself may be described as the back of the pogo stick 100. The outlet 120 is generally positioned on the front of the pogo stick, i.e. on the far side of the frame 102 from the user. The outlet 120 therefore allows the liquid to be fired forward, and away from the user. Many other outlet positions could be used.

In this embodiment, the pogo stick 100 further comprises a trigger 122 which, when activated, opens a valve, so allowing the liquid to be expelled.

In alternative or additional embodiments, the outlet 120 may be arranged on a pivotable mount (not shown) such that the direction in which water is fired can be adjusted by a user. The outlet 120 may be pivotable in a single plane; in such embodiments rotation may be left-right rotation in the horizontal plane, and may have a rotation angle of 45° to 270° and optionally around 180°. In alternative or additional embodiments, the outlet 120 may also be pivotable vertically, to allow lower or higher targets to be reached without tipping the pogo stick 100.

In at least some embodiments wherein the outlet 120 is pivotable, one or more pivot control levers may be provided on or near the handles 118. The control levers may offer discrete or continuous angle adjustment.

In alternative or additional embodiments, one or more shields or casings may be provided. The shields may be detachably connected to the frame 102, or may be integral with the frame 102, and may be arranged to cover the containers 110, 112 so as to protect them from any impacts. The shields may be located substantially on the front of the pogo stick 100. In some embodiments, the shields extend towards the back of the pogo stick, advantageously offering protection for the containers 110, 112 (which are located on the front of the pogo stick 100 in at least some embodiments) from any side impacts. In alternative or additional embodiments, the shields may extend all the way around the pogo stick frame 102 and containers 110, 112, and may be thought of as a casing around the pogo stick 100. The casing may be substantially cylindrical in shape. Advantageously, the shields/casings may also protect a user from water fired by other pogo stick users. The shields may be replaceable and customisable, and may be shaped and decorated in many different ways.

FIGS. 9A, 9B and 10 show a pogo stick 400 according to an alternative embodiment of the invention. The frame 402 and elongate member 404 are as described for those of the embodiments discussed above.

The pogo stick 400 has a liquid container 410 fixedly mounted on the frame 402 and positioned centrally with respect to the frame 402 and in front of the elongate member 404. The gas container 412 (which cooperates with/is the compression chamber of the air pump 408) is positioned above the liquid container 410.

The footrests 416 are formed as a single piece connected to the frame 402. The elongate member 404 is slideable relative to the footrests.

When a user jumps on the pogo stick 400, the frame 402 moves down relative to the elongate member 404 by a distance H as shown in FIG. 20. The linear movement of the elongate member 404 with the working length H is used as the source of power. The value of H will vary with factors such as weight of a user, height of jump and spring 406 strength.

At least some of the energy of this linear movement is stored in the form of compressed air. Air is compressed by the air pump 408, in which the movement of the piston (408*b*) is H.

The air is pumped into the liquid container 410; compressed air within the liquid container increases the pressure in the liquid container. When the trigger 422 is pressed, the compressed air expands, forcing the water in the liquid container through the tubing and out through the nozzle 420. The tubing extends to near the bottom of the liquid container 410 such that liquid can reach the tube even when the liquid level is low, and that the air is not lost until the liquid container is almost empty.

The pump 408 is arranged differently from that shown in the embodiments described above. A slide bar 451 is slideably mounted on the frame 402, parallel to the elongate member 404. The bottom of the slide bar 451 is connected to the bottom of the piston 408*b* of the pump 408. The top of the slide bar 451 is arranged to cooperate with the top of the elongate member 404, such that the slide bar 451 is pushed upwards when the frame 402 moves downwards with respect to the elongate member 404.

In the embodiment shown, the slide bar 451 is not connected to the elongate member, but rather has a rest 451*a* arranged to be pushed upwards by the top of the elongate member 404. A spring 451*b* arranged around the slide bar 451 biases the slide bar downwards, so returning it to its original position when the elongate member 404 moves downwards. In alternative embodiments, the top of the slide bar 451 is connected to the elongate member 404 and no spring 451*b* is needed.

In the embodiment shown, a connector 424 is rigidly connected to the frame 402 and connects the air container 412 to the frame. The connector 424 has two apertures therethrough—one to allow passage of the slide bar 451 through the connector and one to allow passage of the elongate member 404 through the connector.

If the pressure in the liquid container 410 is too high, a safety valve 460 (pressure-release valve) is activated to release some or all of the compressed air from the top of the liquid container. In this way, the linear movement of the elongate member 404 is maintained and the firing apparatus is not damaged by excessive pressure. As the safety valve 460 is at the top of the liquid container 410, no liquid should be lost.

A screw-cap 470 is provided at the top of the liquid container 410 to allow refilling. In alternative embodiments, the whole top of the liquid container 410 may be arranged to be removed, and/or a form of lid other than a screw may be used.

The trigger 422 is provided as a central push-button instead of as a handle on the grip portion of the handlebar. Advantageously, this may allow a user to press the trigger 422, for example with a thumb, whilst retaining a tight grip on the handlebars 418. The trigger 422 is biased towards the closed position with a spring such that the flow of water is cut off when the trigger is released.

The nozzle 420 is of a different form from the nozzle 120 shown in the other embodiments described above. The firing apparatus 430 comprises a ball valve 423.

When the trigger 422 is pressed, a handle 425 is moved forward, causing a rotatable member 427 to rotate, so opening the ball valve.

FIG. 11 shows a kit of parts 4000 which can be used to transform a prior art pogo stick into the pogo stick 400 shown in FIGS. 9A and 9B.

In addition to the parts described above, the kit of parts includes a second connector 424 arranged to rigidly connect the liquid container 410 to the frame 402 and also tubing to take compressed air from the air container 412 (i.e. the housing or compression chamber of pump 408) to the liquid container 410 and to take water from the liquid container 410 to the nozzle 420. The trigger 422 is arranged to be connected to or near the handlebars of the pogo stick 400.

Each connector 424 is conveniently made in two parts—424*a*, 424*b*. The parts 424*a*, 424*b* cooperate to form a loop around each arm of the frame 402 tight enough to grip the frame when the parts are connected together (e.g. using one or more screws). The parts 424*a*, 424*b* cooperate to form a loop around the elongate member 404 wide enough to allow the elongate member 404 to freely slide through the mount.

Kits 5000 and 6000 are equivalent to kit 4000 except that the firing apparatus 430, 530, 630 is different. The firing apparatus of kits 5000 and 6000 may be cheaper to manufacture but less effective in high-pressure usage.

Firing apparatus 530 comprises a push-button trigger 522 like that described for firing apparatus 430, but pushing the trigger again causes linear motion of a piston 531 within the firing apparatus instead of rotation of a ball valve. When the trigger 522 is pressed, the handle 525 moves the piston 531 to open the valve. The head of the piston 531*a* is made from a resiliently deformable material; in this case, rubber. The piston head 531*a* deforms when the piston 531 moves, playing two functions: (i) opening and closing the valve, and (ii) avoiding water leakage. Deformation of the rubber against the inside of the nozzle 520 provides a watertight seal in the closed position of the valve. A spring is provided to bias the piston 531 towards the closed position.

Firing apparatus 630 comprises a push-button trigger 622 like that described for kit 5000. When the trigger 622 is pressed, the handle 625 moves the piston 631 backwards (i.e. away from the nozzle 620) to open the valve. The head of the piston 631*a* is at least partially conical in shape, and arranged to cooperate with the inside of the nozzle so as to block it fully when in the forward position, towards which the piston is biased. Sealing rings 633 prevent water leakage into the trigger mechanism. The shooting direction can be controlled via the use of the screw 635.

If there is the overloading (for example, an adult using a pogo stick designed for a child), the movement length of the elongate member 404 with respect to the frame 402 may be bigger than the working length of the piston 408*a* of the air-pump 408. This may cause damage to the air-pump. In order to solve this problem, an additional strong spring 900 is used in some embodiments to gradually reduce the jumping load, and to effectively control the linear movement length of the pump.

FIG. 24 shows this modification which is present in pogo stick 400 and can be applied to any other embodiments of the invention.

A spring 900 is provided near the bottom of the elongate member 904. The elongate member 904 has a sprung portion in the region of spring 900, allowing the elongate member 904 to be compressed if a large force is applied. Spring 900 is therefore much stiffer than spring 906, such that the elongate member 904 is substantially rigid in normal use (such that energy from bouncing is used to compress air insofar as possible).

In case of loads greater than those for which the pogo stick is rated, the spring 900 is compressed and the sprung portion of the elongate member 904 moves into or around the remainder of the elongate member 904 in a sleeve-like fashion, so reducing the length of the elongate member and preventing over-stretching of the pump.

Pogo stick 700, shown in FIG. 25, is a pogo stick made using the kit of parts 5000 and additional electrical energy generation, storage and usage apparatus.

The energy generation apparatus comprises a pair of electricity-generating shock absorbers (EGSAs) 780 mounted on the frame 702. The EGSAs are arranged on the back of the pogo stick 700, on the opposite side of the elongate member 404 from the liquid container 710 and parallel to the elongate member 704. The slide bar 751 is arranged to actuate the EGSAs, thereby generating electricity.

In alternative embodiments, more or fewer EGSAs may be used, and/or the piston of the or each EGSA may be directly connected to the elongate member 704 instead of using a separate slide bar. Additionally or alternatively, the or each EGSA may be mounted on the elongate member, with the piston connected to the frame. The generated electrical energy is transferred to an energy storage device 783 via wires 781.

The energy storage device 783 comprises two rechargeable batteries in the embodiment shown. The batteries 783 are contained within a housing mounted on the handlebars. Other batteries or capacitors, or combinations of the two, may be used in other embodiments.

The stored energy is used to power an LCD (liquid crystal display) screen 785. The processor is arranged to generate output to be shown on the display. Alternatively, or additionally, the stored energy is used to power a mobile device (such as a mobile phone, phablet or tablet) via a docking station.

The housing also contains a "smart sport device" 787. The smart sport device 787 comprises a memory and a processor. The smart sport device 787 comprises sensors (not shown) arranged to detect the remaining amount of water within the liquid container and to count the bounces and record the energy expended by a user for each bounce (which can be calculated from the distance H the elongate member moves relative to the frame and the spring strength). The display 785 is arranged to show an alert when the water level in the liquid container is low. A user can request to see total energy expenditure, maximum energy of a single bounce, or other data recorded by the sensors, on the display.

The smart sport device 787 comprises a GPS receiver (not shown) arranged to allow a user's position and movements during a use session to be recorded. In this way, a user may see how far s/he has traveled, and/or review movements during a game so as to improve tactics for a later game.

The smart sport device 787 comprises a transmitter (not shown) arranged to allow data stored in the memory to be transmitted to another electronic device, for example a mobile telephone. A user can therefore keep a record of his or her performance.

In alternative embodiments, more or fewer, or different, sensors, transmitters, receivers, output devices (e.g. lights, buzzers, screens) and the like may be provided, and/or no transmitter or sensor may be provided. In alternative or additional embodiments, a physical data transfer connection is provided; for example a USB slot or the like.

In alternative or additional embodiments, one or more water sensors are provided, either mounted on the pogo stick or for a user to wear. In competitive games, the water sensors may record hits so as to reduce cheating and show player statistics.

The skilled person would understand that the electricity generation apparatus can also be used for pogo sticks without water-firing capabilities. Kit of parts 7000 illustrates components that can be used to modify a pogo stick to have electricity generation, storage and usage capabilities.

In embodiments with both water-firing and electricity-generation capabilities, electrical valves and/or pumps, or electrically-assisted mechanical valves and/or pumps may be used to fire water in place of purely mechanical equivalents.

The connectors 726 in the embodiment shown have loops to receive a liquid container 110 and an air container 112, but these loops may be omitted in embodiments not intended to be used to fire water.

The skilled person would understand that various modifications may be made to the pogo stick 100, 200, 300, 400 without departing from the scope of the claims. For example, different numbers of liquid containers and/or of compressible fluid containers may be provided. By way of further example, the containers may be connected to the footrest, elongate member and/or handles instead of being connected to the frame of the pogo stick.

In still further examples, one or more containers may be integral with the frame, such that a portion of the frame contains the liquid to be fired and/or the compressible fluid. Such embodiments may make refilling the liquid container more onerous, but may reduce the risk of components being misplaced or damaged.

The invention may be understood with reference to the following clauses:

1. A pogo stick comprising a frame; an elongate member in sprung connection with the frame, for reciprocating motion between the elongate member and the frame; a liquid container arranged, in use, to contain a liquid; and firing apparatus arranged to utilise the reciprocating motion between the elongate member and the frame to expel the liquid in the liquid container from the pogo stick.

2. The pogo stick of clause 1 wherein the firing apparatus comprises a pump.

3. The pogo stick of clause 2 comprising a compressible fluid container arranged, in use, to contain a compressible fluid, and wherein the pump is arranged to pressurise the compressible fluid.

4. The pogo stick of clause 3 wherein the compressible fluid is pressurised by introduction of liquid from the liquid container into the compressible fluid container.

5. The pogo stick of clause 3 or clause 4 wherein the compressible fluid is pressurised by introduction of atmospheric air into the compressible fluid container.

6. The pogo stick of any preceding clause further comprising a trigger and a valve, and wherein when the trigger is activated, the valve is opened so as to allow the liquid to be expelled from the pogo stick.

7. The pogo stick of any preceding clause further comprising a forward-facing outlet for the liquid, arranged such that the liquid is expelled through the outlet.

8. The pogo stick of clause 6, as it depends from clause 4, further comprising an outlet, and wherein when the trigger is activated, a valve between the compressible fluid container and the outlet is opened such that, in use, expansion of the compressible fluid within the compressible fluid container expels the liquid from compressible fluid container via the outlet.

9. The pogo stick of clause 6, as it depends from clause 5, further comprising an outlet, and wherein when the trigger is activated, a valve between the at least one liquid container and the compressible fluid container is opened such that, in use, expansion of the compressible fluid into the liquid container expels the liquid from the at least one liquid container via the outlet.

10. The pogo stick of any of clauses 3 to 9, further comprising a pressure release valve arranged to vent some or all of the compressible fluid from the compressible fluid container if the pressure exceeds a threshold.

11. The pogo stick of any preceding clause, further comprising a pressure release valve arranged to vent some or all of the liquid if the pressure exceeds a threshold.

12. The pogo stick of any preceding clause wherein the liquid container is located on the front of the pogo stick.

13. The pogo stick of any preceding clause wherein the liquid container is aligned parallel to, and located close to, a vertical axis of the pogo stick.

14. The pogo stick of any preceding clause wherein at least two liquid containers are used, and wherein further the at least two liquid containers are arranged symmetrically with respect to a vertical axis through the pogo stick.

15. The pogo stick of any preceding clause wherein the or each liquid container is located on the lower half of the pogo stick.

16. The pogo stick of any preceding clause wherein the elongate member has a foot arranged, in use, to contact the ground, and wherein the foot is a stabilising foot, arranged, in use, to allow a user to balance in a stationary upright position.

17. The pogo stick of any preceding clause wherein the pump comprises two pump sections, a piston and a compression chamber, and wherein one pump section is connected to the frame and the other pump section is connected to the elongate member.

18. The pogo stick of any preceding clause wherein the frame further comprises at least one footrest.

19. The pogo stick of any preceding clause, wherein the outlet is pivotable such that a direction in which liquid is expelled can be varied.

20. The pogo stick of clause 19 further comprising a control lever, and wherein the outlet can be pivoted using the control lever.

21. The pogo stick of any preceding claim further comprising a shield or casing arranged to protect the liquid container from impacts.

22. The pogo stick of any preceding clause wherein multiple outlets are provided.

23. The pogo stick of any preceding clause wherein the liquid container is detachably connected to the frame.

24. A pogo stick set comprising the pogo stick of any preceding clause; a plurality of containers of various sizes, the containers being suitable for containing liquid and/or for compressible fluid; and a selection of detachable connectors arranged, in use, to connect one or more of the containers to the pogo stick.

25. The pogo stick set of clause 24 further comprising one or more detachable shields or casings, arranged, in use, to protect the or each container connected to the pogo stick from impacts.

The invention claimed is:

1. A water-firing pogo stick comprising:

a frame;

a footrest connected to the frame;

an elongate member in sprung connection with the frame, for reciprocating motion between the elongate member and the frame, the elongate member comprising a foot arranged to make contact with the ground;

a liquid container holding water; and firing apparatus arranged to utilise the reciprocating motion between the elongate member and the frame that is generated by a user bouncing up and down on the pogo stick to expel the water in the liquid container from the pogo stick.

2. The pogo stick of claim 1 wherein the firing apparatus comprises a pump.

3. The pogo stick of claim 2 comprising a compressible fluid container arranged, in use, to contain a compressible fluid, and wherein the pump is arranged to pressurise the compressible fluid.

4. The pogo stick of claim 3, wherein the compressible fluid container is a compression chamber of the pump, and wherein compressed fluid can be pumped into the liquid container, so raising the pressure within the liquid container.

5. The pogo stick of claim 3, further comprising a pressure release valve arranged to vent some or all of the compressible fluid if the pressure exceeds a threshold.

6. The pogo stick of claim 1, wherein the liquid container is located on the front of the pogo stick.

7. The pogo stick of claim 1, wherein the liquid container is aligned parallel to, and located close to, a vertical axis of the pogo stick.

8. The pogo stick of claim 1, wherein the elongate member has a foot arranged, in use, to contact the ground, and wherein the foot is a stabilising foot, arranged, in use, to allow a user to balance in a stationary upright position.

9. The pogo stick of claim 1, wherein the pump comprises two pump sections, a piston and a compression chamber, and wherein one pump section is connected to the frame and the other pump section is connected to the elongate member.

10. The pogo stick of claim 1, wherein the liquid container is detachably connected to the frame.

11. A pogo stick comprising:

a frame;

an elongate member in sprung connection with the frame, for reciprocating motion between the elongate member and the frame;

a liquid container arranged, in use, to contain a liquid;

firing apparatus arranged to utilise the reciprocating motion between the elongate member and the frame to expel the liquid in the liquid container from the pogo stick; and a trigger and a valve, and wherein when the trigger is activated, the valve is opened so as to allow the liquid to be expelled from the pogo stick via an outlet.

12. The pogo stick of claim 11, further comprising a pressure release valve arranged to vent some or all of the compressible fluid if the pressure exceeds a threshold.

13. A pogo stick comprising:

a frame;

a footrest connected to the frame;

an elongate member in sprung connection with the frame, for reciprocating motion between the elongate member and the frame, the elongate member comprising a foot arranged to make contact with the ground;

a liquid container arranged, in use, to contain a liquid;

firing apparatus arranged to utilise the reciprocating motion between the elongate member and the frame that is generated by a user bouncing up and down on the pogo stick to expel the liquid in the liquid container from the pogo stick; and a pivotable outlet, such that a direction in which liquid is expelled can be varied.

14. A pogo stick comprising:

a frame;

an elongate member in sprung connection with the frame, for reciprocating motion between the elongate member and the frame;

a liquid container arranged, in use, to contain a liquid;

firing apparatus arranged to utilise the reciprocating motion between the elongate member and the frame to expel the liquid in the liquid container from the pogo stick; and electricity generation apparatus arranged to generate electricity from the reciprocating motion between the elongate member and the frame.

15. The pogo stick of claim 14, further comprising one or more sensors and a display screen arranged to display data from the one or more sensors using generated electricity.

16. A pogo stick comprising:

a frame;

an elongate member in sprung connection with the frame, for reciprocating motion between the elongate member and the frame;

a liquid container arranged, in use, to contain a liquid;

firing apparatus arranged to utilise the reciprocating motion between the elongate member and the frame to expel the liquid in the liquid container from the pogo stick;

a plurality of containers of various sizes, the containers being suitable for containing liquid and/or compressible fluid; and a selection of detachable connectors arranged, in use, to connect one or more of the containers to the pogo stick.

17. A kit of parts for modifying a pogo stick comprising a frame and an elongate member in sprung connection with the frame, for reciprocating motion between the elongate member and the frame to have water-firing capabilities, the kit of parts comprising:

a liquid container arranged, in use, to contain a liquid;

a first connector attachable between the liquid container and the pogo stick so as to secure the liquid container to the pogo stick; and firing apparatus arranged to be coupled to the frame and the elongate member so as to utilise the reciprocating motion between the elongate member and the frame to expel the liquid in the liquid container from the pogo stick; and electricity generation and storage apparatus, the electricity generation apparatus being arranged to generate electrical energy from the reciprocating motion between the elongate member and the frame.

18. The kit of parts of claim 17, further comprising parts for modifying a pogo stick to have electricity generation and storage capabilities, the parts comprising:

electricity-generating apparatus arranged to be connected to the frame of the pogo stick and to utilise reciprocating motion between the elongate member and the frame of the pogo stick to which it is, in use, connected to generate electricity;

an energy storage device arranged to store the generated energy; and a connector arranged to connect the electricity generating apparatus and the energy storage device to the pogo stick.

19. A pogo stick comprising:

a frame;

an elongate member in sprung connection with the frame, for reciprocating motion between the elongate member and the frame;

electricity-generating apparatus connected to the frame and arranged to utilise reciprocating motion between the elongate member and the frame to generate electricity; and an energy storage device connected to the frame and arranged to store generated electricity.

* * * * *